US009828989B2

(12) United States Patent
Yokoi et al.

(10) Patent No.: US 9,828,989 B2
(45) Date of Patent: Nov. 28, 2017

(54) DEVICE FOR DELIVERING LIQUID AT A STABLE FLOW RATE

(71) Applicant: MURATA MANUFACTURING CO., LTD., Nagaokakyo-Shi, Kyoto-fu (JP)

(72) Inventors: Hiroyuki Yokoi, Nagaokakyo (JP); Yuzo Higashiyama, Nagaokakyo (JP)

(73) Assignee: MURATA MANUFACTURING CO., LTD., Nagaokakyo-shi, Kyoto-fu (JP)

( * ) Notice: Subject to any disclaimer, the term of this patent is extended or adjusted under 35 U.S.C. 154(b) by 25 days.

(21) Appl. No.: 14/572,112

(22) Filed: Dec. 16, 2014

(65) Prior Publication Data

US 2015/0167664 A1 Jun. 18, 2015

Related U.S. Application Data

(63) Continuation of application No. PCT/JP2013/065802, filed on Jun. 7, 2013.

(30) Foreign Application Priority Data

Jun. 22, 2012 (JP) ..... 2012-141268
Nov. 28, 2012 (JP) ..... 2012-259302

(51) Int. Cl.

| | |
|---|---|
| ***F04B 53/10*** | (2006.01) |
| ***F04B 43/00*** | (2006.01) |
| ***F04B 43/02*** | (2006.01) |
| ***F04B 23/02*** | (2006.01) |
| ***F04B 39/10*** | (2006.01) |

(Continued)

(52) U.S. Cl.

CPC ..... *F04B 53/103* (2013.01); *F04B 23/02* (2013.01); *F04B 39/102* (2013.01); *F04B 43/00* (2013.01); *F04B 43/02* (2013.01); *F04B 53/109* (2013.01); *F04B 53/1087* (2013.01); *F04B 2205/05* (2013.01)

(58) Field of Classification Search

CPC .... F04B 53/10; F04B 53/102; F04B 53/1022; F04B 53/103; F04B 53/1032;

(Continued)

(56) References Cited

U.S. PATENT DOCUMENTS 3,774,628 A * 11/1973 Norton ..... F16K 17/085 137/115.15
5,174,326 A * 12/1992 Steinert ..... G05D 16/0636 137/468

(Continued)

FOREIGN PATENT DOCUMENTS

JP 2003-185053 A 7/2003
JP 2012-021623 A 2/2012

(Continued)

OTHER PUBLICATIONS

Machine Translation of WO 2010/137578 Espacenet Nov. 17, 2014.*
Written opinion and International Search Report issued in PCT/JP2013/065802 dated Sep. 10, 2013.

*Primary Examiner* — Bryan Lettman
*Assistant Examiner* — Timothy Solak
(74) *Attorney, Agent, or Firm* — Arent Fox LLP

(57) ABSTRACT

A liquid delivery device includes a constant flow valve, a pump and channels. A medicinal solution bag is connected to the liquid delivery device. The pump has a suction aperture, a discharge aperture and check valves. The constant flow valve includes a valve casing and a diaphragm that partitions the interior of the valve casing to form a first valve chamber and a second valve chamber. A first opening, a second opening, and a third opening are provided in the valve casing. A conical spring arranged between and in contact with a top plate and the diaphragm is provided in the second valve chamber. The spring applies a pressure towards an O-ring side to a second main surface of the diaphragm.

16 Claims, 18 Drawing Sheets

(58) Field of Classification Search
CPC ..... F04B 53/1035; F04B 53/1085; F04B 53/1087; F04B 43/02; F04B 13/00; F04B 23/02; F04B 39/08; F04B 43/00; F04B 49/002; F04B 49/08; F04B 39/10; F04B 39/102; F04B 49/22; F04B 43/0081; F04B 2205/05; F04B 2205/063; F04B 2205/16; F04B 2205/06; F04B 53/109; G05D 16/0655; G05D 16/0658; G05D 16/0661
See application file for complete search history.

(56) References Cited

U.S. PATENT DOCUMENTS 5,255,711 A * 10/1993 Reeds ..... G05D 16/0655 137/505.41
2002/0066482 A1* 6/2002 Pulli ..... F04B 49/03 137/115.06
2003/0111178 A1* 6/2003 Morita ..... F16K 7/14 156/345.33
2009/0131351 A1* 5/2009 Green ..... A61K 31/711 514/44 R
2010/0032606 A1* 2/2010 Strobel ..... F16K 15/183 251/333
2010/0074775 A1* 3/2010 Yamamoto ..... F04B 43/028 417/413.2
2011/0297253 A1* 12/2011 Akagi ..... F02M 37/0029 137/511
2012/0244454 A1 9/2012 Maeda et al.
2013/0111178 A1 5/2013 Driever et al.

FOREIGN PATENT DOCUMENTS

WO 2010/137578 * 12/2010 ..... F16K 31/126
WO WO-2010-137578 A1 12/2010

* cited by examiner

PRIOR ART

PRIOR ART

DEVICE FOR DELIVERING LIQUID AT A STABLE FLOW RATE

CROSS REFERENCE TO RELATED APPLICATIONS

The present application is a continuation of PCT/JP2013/065802 filed Jun. 7, 2013, which claims priority to Japanese Patent Application No. 2012-141268, filed Jun. 22, 2012 and Japanese Patent Application No. 2012-259302, filed Nov. 28, 2012, the entire contents of each of which are incorporated herein by reference.

FIELD OF THE INVENTION

The present invention relates to a liquid delivery device that delivers a liquid stored in a liquid storage unit to a liquid consumption unit via a valve.

BACKGROUND OF THE INVENTION

In the related art, liquid delivery devices that deliver a liquid stored in a liquid storage unit to a liquid consumption unit via a valve are known such as the device described in International Publication No. 2010/137578 (hereinafter "Patent Document 1").

FIG. 17 is an outline structural view of a liquid delivery device 800 described in Patent Document 1. This liquid delivery device 800 includes a fuel cartridge 1 (liquid storage unit) that stores a liquid fuel, a pressure resistant valve 2, a passive valve 3, a pump 4 that transports the fuel, a power generating cell 5 (liquid consumption unit) that receives supply of the fuel from the pump 4 and generates power, and channels 7 and 8. The fuel is for example methanol.

The pump 4 includes a suction aperture 41 through which the fuel is sucked, a discharge aperture 42 through which the fuel is discharged, and check valves 43 and 44 that prevent reverse flow of the fuel.

The passive valve 3 includes a valve casing 10 and a diaphragm 20 that partitions the interior of the valve casing 10 to form a first valve chamber 11 and a second valve chamber 12 inside the valve casing 10.

A first opening 15 that is in communication with the first valve chamber 11, a second opening 16 that is in communication with the second valve chamber 12, and a third opening 17 that is in communication with the first valve chamber 11 are formed in the valve casing 10. In addition, the valve casing 10 is provided with an O-ring (valve seat) 30 that protrudes from the periphery of the third opening 17 towards the diaphragm 20 side and is in contact with the diaphragm 20.

The fuel cartridge 1 is connected to the second opening 16 of the passive valve 3 and the suction aperture 41 of the pump 4 via the pressure resistant valve 2 and the channel 7. The discharge aperture 42 of the pump 4 is connected to the first opening 15 via the channel 8. In addition, the third opening 17 is connected to the power generating cell 5.

In the above-described configuration, when operation of the pump 4 is started, the fuel stored in the fuel cartridge 1 flows into the first valve chamber 11 from the first opening 15 via the pressure resistant valve 2, the channel 7, the pump 4 and the channel 8, and the pressure of the fuel is increased inside the first valve chamber 11.

As a result, the diaphragm 20 of the passive valve 3 curves toward the second valve chamber 12 side and becomes separated from the O-ring 30, and the first opening 15 and the third opening 17 come to be in communication with each other. That is, the passive valve 3 is opened.

Thus, the fuel stored in the fuel cartridge 1 is supplied to the power generating cell 5 via the pressure resistant valve 2, the channel 7, the pump 4, the channel 8, and the passive valve 3 by operation of the pump 4. The power generating cell 5 receives supply of the fuel and generates power.

However, the pump 4 described in Patent Document 1 has a P-Q (pressure-flow rate) characteristic as illustrated in FIG. 18. That is, when the pressure P (difference between discharge-side pressure and suction-side pressure varies, the flow rate Q varies. Consequently, in the liquid delivery device 800, there is a problem in that if a change occurs in the surrounding environment such as the channel resistance of for example a tube that connects the passive valve 3 and the power generating cell 5, the discharge-side pressure varies and the flow rate changes and therefore the flow rate of the fuel supplied to the power generating cell 5 is not stable.

SUMMARY OF THE INVENTION

Accordingly, an object of the present invention is to provide a liquid delivery device that is capable of making the flow rate of a liquid supplied to a liquid consumption unit stable even when for example a change occurs in the surrounding environment.

A liquid delivery device of the present invention has the following configuration in order to solve the above-described problem.

(1) The liquid delivery device includes a valve including a valve casing provided with a first opening and a second opening and a valve seat that is arranged around a periphery of the first opening or the second opening, a diaphragm that has a first main surface that faces the valve seat and a second main surface on the opposite side to the first main surface and connected to or in contact with a space outside the valve casing, that is fixed to the valve casing and together with the valve casing forms a valve chamber, and a pressure-applying portion that applies a pressure toward the valve seat side to the second main surface of the diaphragm, and a pump having a suction aperture and a discharge aperture that is connected to the first opening.

In this configuration, the suction aperture of the pump is connected to a liquid storage unit that stores a liquid. In addition, the second opening of the valve is connected via for example a tube to a liquid consumption unit that consumes the liquid. In this configuration, the liquid stored in the liquid storage unit is made to flow into the valve chamber from the first opening of the valve via the pump, flows out from the second opening and is supplied to the liquid consumption unit by operation of the pump.

In this configuration, the diaphragm allows the first opening and the second opening to communicate with each other and blocks communication between the first opening and the second opening in accordance with the difference between the pressure applied to the first main surface and the pressure applied to the second main surface. A discharge pressure of the pump from the first opening and pressure from the second opening are applied to the first main surface of the diaphragm. In addition, a pressure toward the valve seat side is applied to the second main surface of the diaphragm by the pressure-applying portion.

Accordingly, with this configuration, during delivery of the liquid, even if the pressure that is being applied to the region of the first main surface of the diaphragm that is in communication with the second opening suddenly increases due to a change in for example the channel resistance of the tube connecting the second opening of the valve and the liquid consumption unit, a change in the discharge flow rate of the liquid delivery device is suppressed up to the pressure applied by the pressure-applying portion. With this configuration, even if for example a change occurs in the surrounding environment of the liquid delivery device, the flow rate of the liquid being supplied to the liquid consumption unit can be stabilized.

(2) It is preferable that the valve be provided so that a relationship $1<\alpha\leq\beta\gamma+1$ is satisfied in a range $0\leq P_O<P_S$ where $S_P$ denotes an area of a region of the first main surface of the diaphragm that is in communication with the first opening, $S_S$ denotes an area of the second main surface of the diaphragm, $P_1$ denotes a discharge pressure of the pump when a discharge flow rate of the pump is zero, $P_S$ denotes a pressure applied to the second main surface of the diaphragm by the pressure-applying portion, $P_O$ denotes a pressure applied to a region of the first main surface of the diaphragm that is in communication with the second opening, a denotes $S_S/S_P$ ($\alpha>1$), $\beta$ denotes $P_1/P_S$ ($\beta>1$), and $\gamma$% denotes a flow rate accuracy.

With this configuration, the constant flow valve is provided so as to satisfy the relationship $1<\alpha\leq\beta\gamma-\gamma+1$. Accordingly, even if a change occurs in the surrounding environment of liquid delivery device and the pressure $P_O$ being applied to the region of the first main surface of the diaphragm that is in communication with the second opening suddenly increases, provided that the pressure $P_O$ is in the range $0\leq P_O<P_S$, changes in the discharge flow rate of the liquid delivery device are suppressed. Therefore, with this configuration, even if for example a change occurs in the surrounding environment of the liquid delivery device, the flow rate of the liquid being supplied to the liquid consumption unit can be stabilized.

(3) It is preferable that the flow rate accuracy $\gamma$ be 10%.

With this configuration, even if a change occurs in the surrounding environment of liquid delivery device and the pressure $P_O$ being applied to the region of the first main surface of the diaphragm that is in communication with the second opening suddenly increases, provided that the pressure $P_O$ is in the range $0\leq P_O<P_S$, changes in the discharge flow rate of the liquid delivery device of up to 10% are suppressed.

(4) It is preferable that the pressure-applying portion include an adjustment mechanism with which it is possible to adjust the pressure applied to the second main surface of the diaphragm by the pressure-applying portion.

With this configuration, the pressure that is applied to the second main surface of the diaphragm by the pressure-applying portion can be adjusted by the adjustment mechanism.

Therefore, even if there are individual differences between pumps or valves due to variations in the manufacture of the pumps or valves, the discharge flow rate of the entire liquid delivery device can be adjusted to a certain flow rate in accordance with the individual difference of the pump or valve by using the adjustment mechanism of the valve. That is, with the liquid delivery device, the discharge flow rate of liquid delivery device can be made constant.

(5) It is preferable that the adjustment mechanism include an elastic body and a pressing body that urges the elastic body toward the valve seat side.

In this configuration, the elastic body is for example composed of a spring or rubber.

With this configuration, the pressure that is applied to the second main surface of the diaphragm by the elastic body can be adjusted by urging of the elastic body by the pressing body.

(6) It is preferable that the pressing body be provided in the valve casing so as to be capable of being freely rotated by screwing of a screw having a rotational axis in a direction orthogonal to the diaphragm.

In this configuration, the distance between the pressing body and the diaphragm is determined by rotation of the pressing body.

Therefore, with this configuration, the pressure applied to the second main surface of the diaphragm can be easily adjusted via rotation of the pressing body.

(7) It is preferable that a protruding portion that contacts the valve seat be provided so as to be integrated with the diaphragm.

With this configuration, since a manufacturing step for providing the protruding portion is not necessary, the manufacturing cost of the liquid delivery device can be reduced.

(8) It is preferable that the valve seat be provided so as to be integrated with the valve casing.

With this configuration, since a manufacturing step for providing the valve seat is not necessary, the manufacturing cost of the liquid delivery device can be reduced.

(9) It is preferable that the pressure-applying portion be provided so as to be integrated with the diaphragm.

With this configuration, since a manufacturing step for providing the pressure-applying portion is not necessary, the manufacturing cost of the liquid delivery device can be reduced.

According to the present invention, the flow rate of a liquid supplied to a liquid consumption unit can be stabilized.

DETAILED DESCRIPTION OF THE PREFERRED EMBODIMENTS

First Embodiment of Present Invention

Hereafter, a liquid delivery device 100 according to a first embodiment of the present invention will be described.

Figure 1:
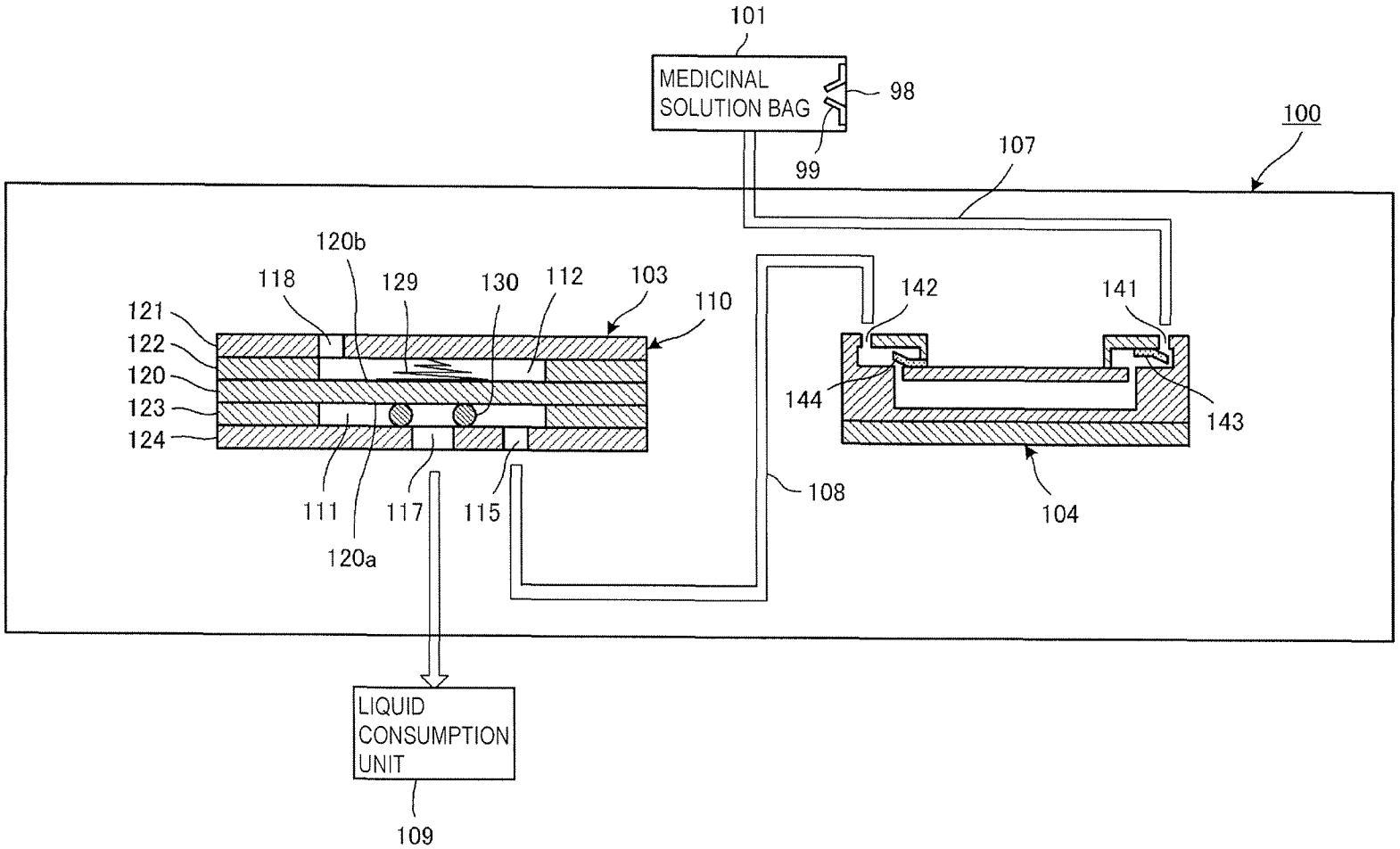
FIG. 1 is an outline structural view of a liquid delivery device 100 according to a first embodiment of the present invention.

FIG. 1 is an outline structural view of the liquid delivery device 100 according to the first embodiment of the present invention. The liquid delivery device 100 includes a pump 104 that transports a medicinal solution, a constant flow valve 103, and channels 107 and 108. As illustrated in FIG. 1, a medicinal solution bag 101 is connected to the liquid delivery device 100.

The medicinal solution bag 101 includes an opening 98 for allowing insertion of a medicinal solution, and a check valve 99 for preventing reverse flow of the medicinal solution. The medicinal solution is for example a glucose infusion.

The pump 104 has a suction aperture 141 for allowing suction of the medicinal solution stored in the medicinal solution bag 101, a discharge aperture 142 for allowing discharge of the medicinal solution, and check valves 143 and 144 for preventing reverse flow of the medicinal solution. The pump 104 is for example a piezoelectric pump equipped with a piezoelectric element composed of a piezoelectric ceramic.

The constant flow valve 103 has a substantially rectangular parallelepiped shape. The constant flow valve 103 has a valve casing 110 provided with a first opening 115, a second opening 117, and a third opening 118. Furthermore, the constant flow valve 103 includes a diaphragm 120 that has a first main surface 120*a* that faces the first opening 115 and the second opening 117 and a second main surface 120*b* that is on the opposite side to the first main surface 120*a* and faces the third opening 118 so as to be connected to the space outside the valve casing 110. The diaphragm 120 partitions the inside of the valve casing 110 and forms together with the valve casing 110 a first valve chamber 111 provided on the first main surface 120*a* side and a second valve chamber 112 provided on the second main surface 120*b* side. Part of the second main surface 120*b* is exposed to the space outside the constant flow valve 103 via the third opening 118.

In addition, the valve casing 110 is composed of a polyphenylene sulfide (PPS) resin for example. Furthermore, the diaphragm 120 is composed of silicone rubber for example.

The valve casing 110 is provided with the first opening 115 and the second opening 117 that communicate with the first valve chamber 111 and the third opening 118 that communicates with the second valve chamber 112.

The diaphragm 120 is fixed to the valve casing 110 such that the first opening 115 and the second opening 117 are allowed to communicate with each other by the first main surface 120*a* being separated from the upper surface of an O-ring 130, which serves as a valve seat, and such that communication between the first opening 115 and the second opening 117 is blocked by the first main surface 120*a* contacting the entirety of the upper surface of the O-ring 130.

The medicinal solution bag 101 is connected to the suction aperture 141 of the pump 104 via the channel 107. The discharge aperture 142 of the pump 104 is connected to the first opening 115 of the constant flow valve 103 via the channel 108.

Next, the structure of the constant flow valve 103 will be described in detail.

Figure 2:
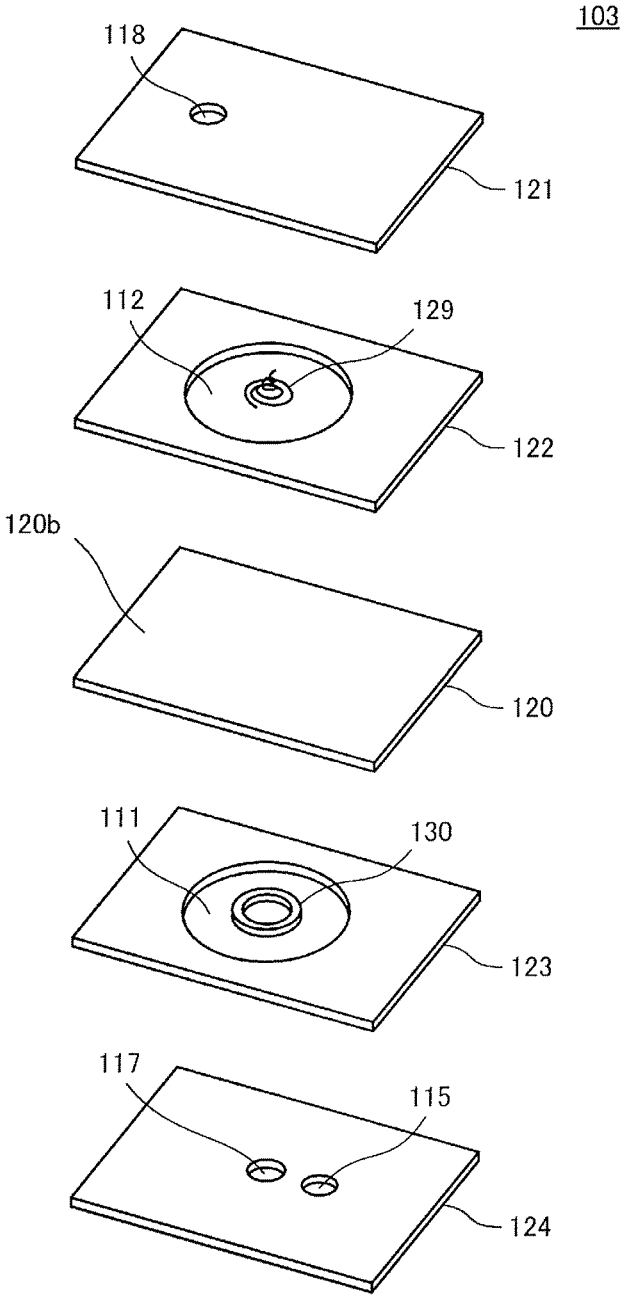
FIG. 2 is an exploded perspective view of a constant flow valve 103 provided in the liquid delivery device 100 illustrated in FIG. 1.
Figure 3A:
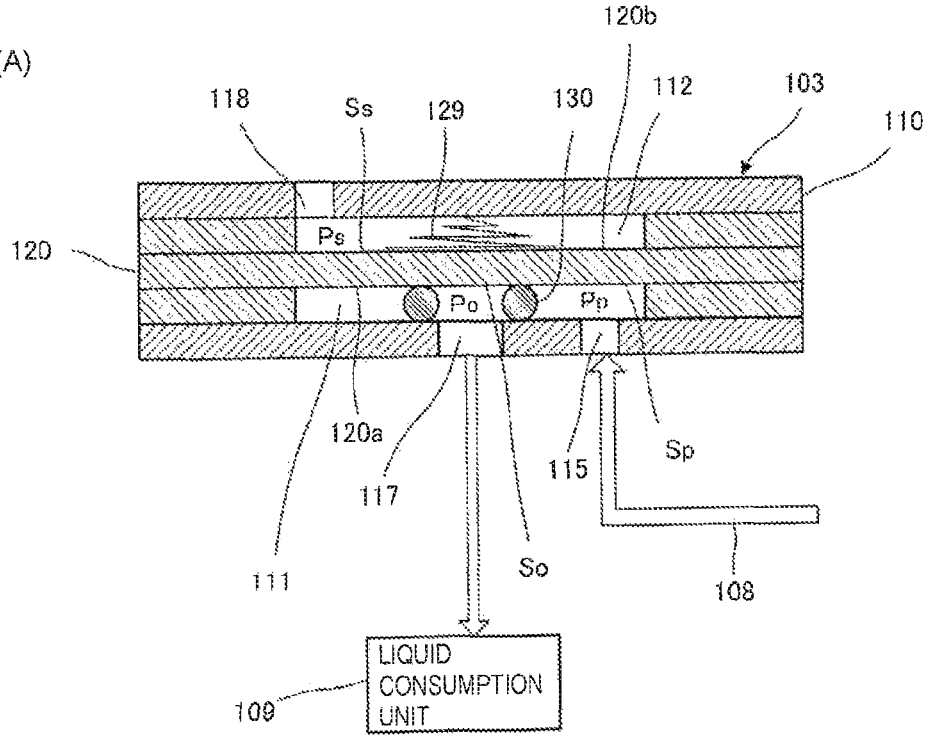
FIG. 3(A) is a sectional view taken when the constant flow valve 103 illustrated in FIG. 1 is closed.
Figure 3B:
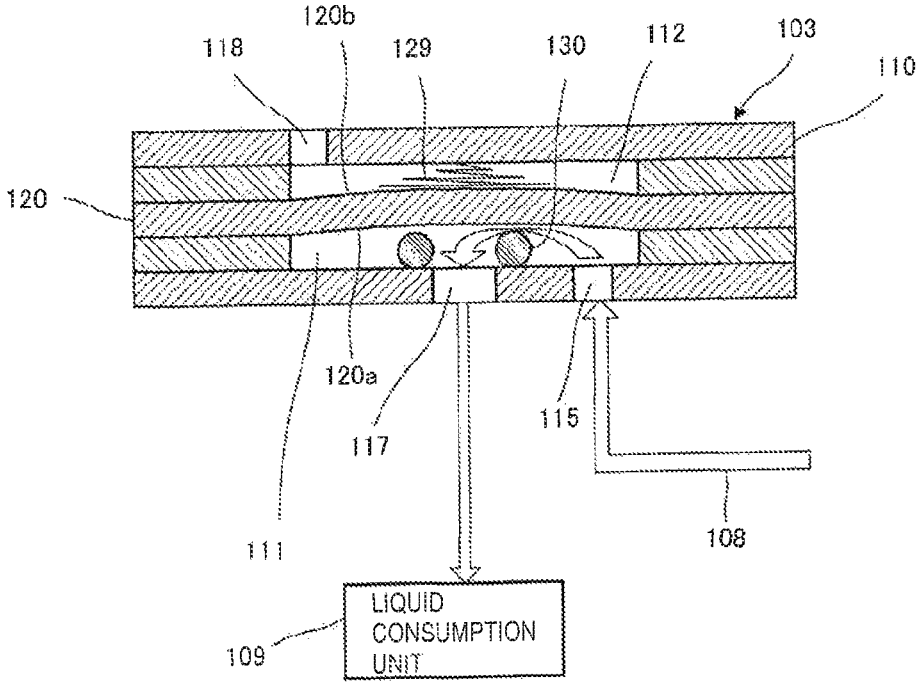
FIG. 3(B) is a sectional view taken when the constant flow valve 103 illustrated in FIG. 1 is open.

FIG. 2 is an exploded perspective view of the constant flow valve 103 provided in the liquid delivery device 100 illustrated in FIG. 1. FIG. 3(A) is a sectional view taken when constant flow valve 103 illustrated in FIG. 1 is closed. FIG. 3(B) is a sectional view taken when the constant flow valve 103 illustrated in FIG. 1 is open.

As illustrated in FIG. 2, the constant flow valve 103 includes a top plate 121 in which the third opening 118 is provided, a side plate 122 in which an opening that is circular when viewed in plan is provided that forms the second valve chamber 112, the diaphragm 120, a side plate 123 in which an opening that is circular when viewed in plan is provided that forms the first valve chamber 111, and a bottom plate 124 in which the first opening 115 and the second opening 117 are provided, and the constant flow valve 103 has a structure obtained by stacking these layers in this order.

Here, the thickness of the side plate 122 defines the height of the second valve chamber 112 and the thickness of the side plate 123 defines the height of the first valve chamber 111.

As illustrated in FIGS. 1 and 2, the O-ring 130 is adhered to the bottom plate 124 in the first valve chamber 111. The O-ring 130 protrudes from the periphery of the second opening 117 towards the diaphragm 120 side and is in contact with the first main surface 120*a* of the diaphragm 120 which faces the first valve chamber 111. The O-ring 130 is for example composed of a nitrile butadiene rubber (NBR).

The O-ring 130 corresponds to a "valve seat" of the present invention.

In addition, as illustrated in FIGS. 1 and 2, the second valve chamber 112 communicates with the space outside the constant flow valve 103 via the third opening 118. Consequently, in this embodiment, the pressure inside the second valve chamber 112 is substantially equal to atmospheric pressure. A conical spring 129 is provided so as to be between and in contact with the top plate 121 and the diaphragm 120 in the second valve chamber 112.

The spring 129 applies a pressure toward the O-ring 130 side to the second main surface 120*b* of the diaphragm 120. The spring 129 is composed of for example a metal or an elastomer.

The spring 129 corresponds to a "pressure-applying portion" of the present invention.

Next, operation of the constant flow valve 103 will be described using FIGS. 1 to 3.

In the constant flow valve 103, the diaphragm 120 is deformed by the difference between the pressure applied to the first main surface 120*a* on the first valve chamber 111 side and the pressure applied to the second main surface 120*b* on the second valve chamber 112 side, and the first main surface 120*a* contacts or is separated from the O-ring 130. Thus, the diaphragm 120 allows communication between the first opening 115 and the second opening 117 or blocks communication between the first opening 115 and the second opening 117.

"A valve closed time" of the constant flow valve 103 refers to a state in which the diaphragm 120 is in contact with the entire upper surface of the O-ring 130. "A valve open time" of the constant flow valve 103 refers to a state in which at least part of the diaphragm 120 is separated from the upper surface of the O-ring 130.

The constant flow valve 103 is closed as illustrated in FIG. 3(A) when a healthcare provider is going to connect the second opening 117 of the constant flow valve 103 to the liquid consumption unit 109 in a state where the pump 104 is stopped. The healthcare provider causes the pump 104 to be driven and then the medicinal solution stored in the medicinal solution bag 101 flows into the first valve chamber 111 from the first opening 115 via the channel 107, the pump 104 and the channel 108 and the pressure of the medicinal solution is increased inside the first valve chamber 111.

Here, as illustrated in FIG. 3(A), when an outer region area of the diaphragm 120 that is positioned outside of the portion that contacts the O-ring 130 at a valve closed time out of the first main surface 120*a* of the diaphragm 120 that faces the first valve chamber 111 is denoted $S_P$, an area of the second main surface 120*b* of the diaphragm 120 that faces the second valve chamber 112 is denoted $S_S$, and an inner region area of the diaphragm 120 positioned inside of the portion that contacts the O-ring 130 at a valve closed time out of the first main surface 120*a* is denoted $S_O$, the discharge pressure of the pump 104 applied to the outer region area $S_P$ of the diaphragm 120 is denoted $P_P$, the pressurizing force of the spring 129 applied to the area $S_S$ of the second main surface 120*b* of the diaphragm 120 is denoted $P_S$, and the pressure applied to the inner region area $S_O$ of the diaphragm 120 is denoted by $P_O$, the case where the constant flow valve 103 is open as illustrated in FIG. 3(B) is expressed by the following Equation 1 from balancing of the pressures $P_P$, $P_S$ and $P_O$. The following Equation 2 is obtained by expanding Equation 1.

[Math. 1]

$$(P_P \times S_P)+(P_O \times S_O)>P_S \times S_S \quad \text{Equation 1}$$

[Math. 2]

$$P_P>\{(P_S \times S_S)-(P_O \times S_O)\}+(S_S-S_O) \quad \text{Equation 2}$$

Accordingly, when the discharge pressure $P_P$ of the pump 104 applied to the outer region area $S_P$ of the diaphragm 120 satisfies Equation 2, the diaphragm 120 of the constant flow valve 103 bends toward the second valve chamber 112 side, the first main surface 120*a* is separated from the upper surface of the O-ring 130 and the first opening 115 and the second opening 117 are able to communicate with each other (refer to FIG. 3(B)). That is, the constant flow valve 103 is opened.

Thus, the medicinal solution stored in the medicinal solution bag 101 flows into the first valve chamber 111 from the channel 107, the pump 104, the channel 108 and the first opening 115 of the constant flow valve 103, flows out from the second opening 117 and is supplied to the liquid consumption unit 109 by operation of the pump 104.

The above-described liquid delivery device 100 is used in medical site such as a hospital. A healthcare provider such as a nurse inserts the medicinal solution into the medicinal solution bag 101 and drives the pump 104 to exhaust air from the inside the channels of the liquid delivery device 100. After the air inside the channels of the liquid delivery device 100 has been exhausted, the healthcare provider connects the second opening 117 of the constant flow valve 103 to the liquid consumption unit 109 via for example a catheter (not illustrated).

Thus, the medicinal solution stored in the medicinal solution bag 101 flows into the first valve chamber 111 from the channel 107, the pump 104, the channel 108 and the first opening 115 of the constant flow valve 103, flows out from the second opening 117 and is supplied to the liquid consumption unit 109 by operation of the pump 104.

The medicinal solution bag 101 corresponds to a "liquid storage unit" of the present invention.

Here, during the delivery of the medicinal solution, if the pressure $P_O$ being applied to the inner region area $S_O$ of the diaphragm 120 suddenly increases due to a channel blockage caused by the size of the inner diameter of a member forming the channel such as a catheter, crushing or bending of the channel or deposition of the medicinal solution, a change may occur in the surrounding environment of the liquid delivery device 100.

However, in the liquid delivery device 100 of this embodiment, the constant flow valve 103 has the spring 129. Consequently, the liquid delivery device 100 is able to suppress changes in the flow rate up to the pressure $P_S$ applied by the spring 129. Therefore, with the liquid delivery device 100 of this embodiment, even if a change occurs in the surrounding environment such as in the channel resistance of a catheter for example connecting the constant flow valve 103 of the liquid delivery device 100 and the liquid consumption unit 109, the flow rate of the medicinal solution supplied to the liquid consumption unit 109 can be stabilized.

Hereafter, a constant flow rate operation of the liquid delivery device 100 during delivery of the medicinal solution will be described in detail.

Figure 4:
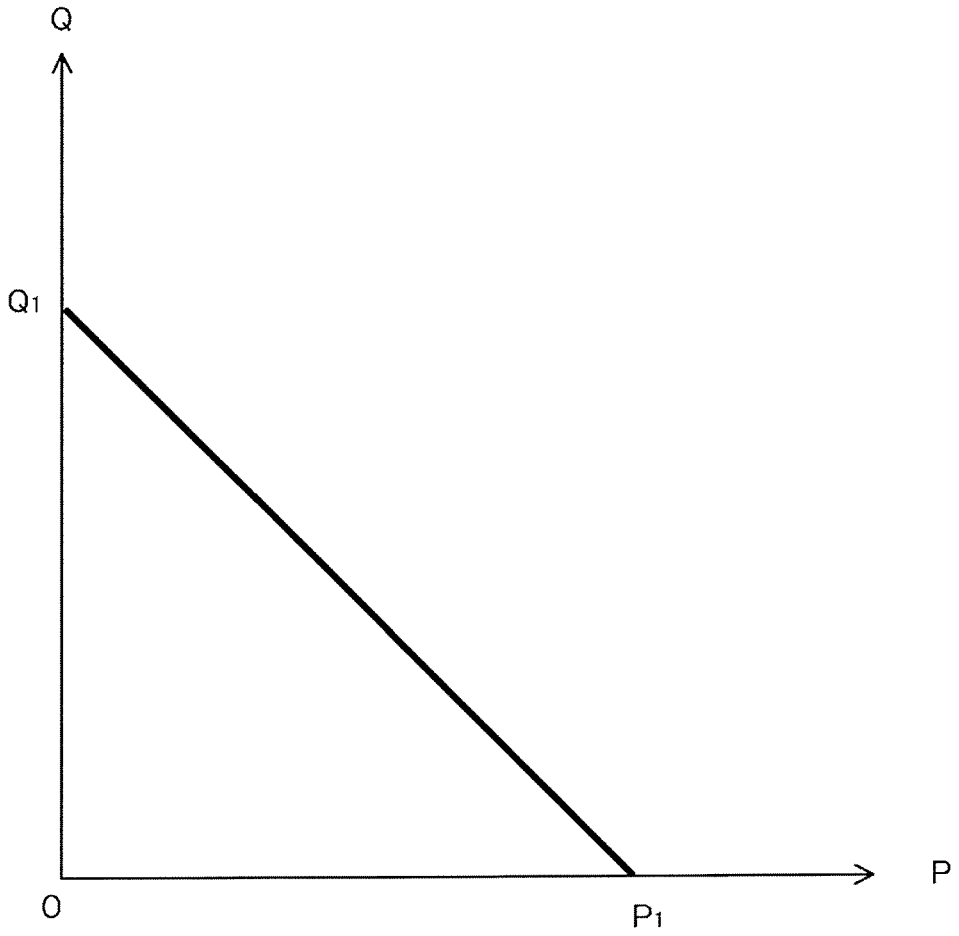
FIG. 4 illustrates a P-Q (pressure-flow rate) characteristic of a pump 104 illustrated in FIG. 1.
Figure 5:
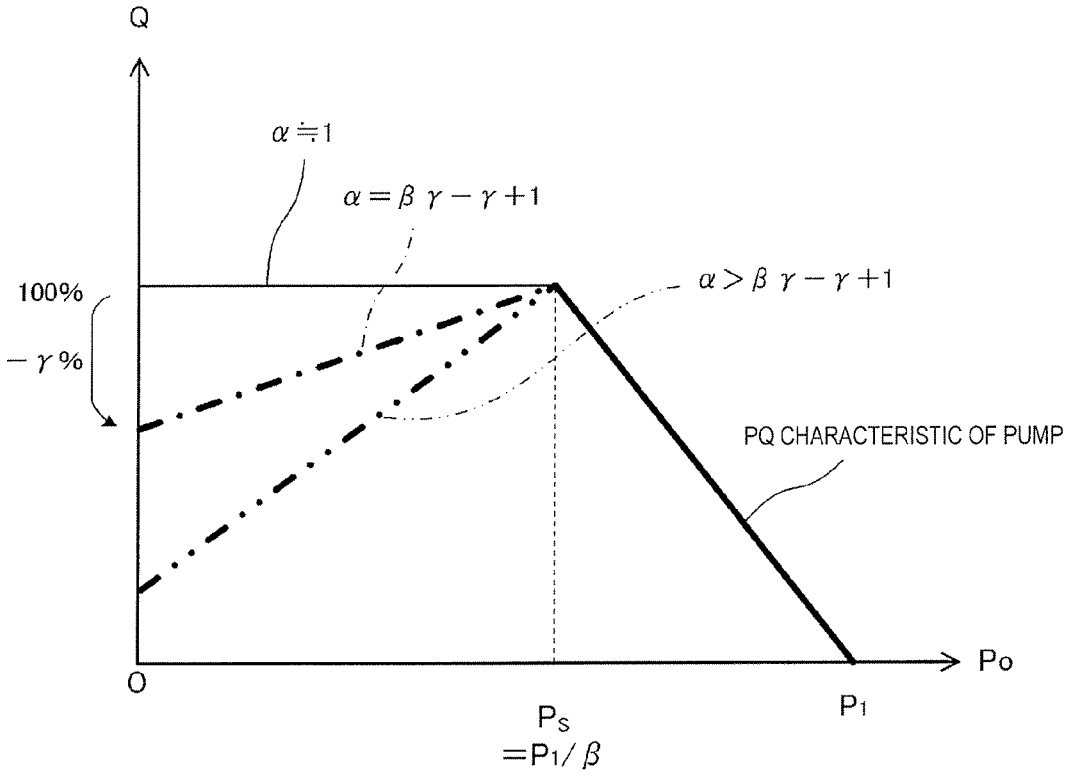
FIG. 5 illustrates a P-Q (pressure-flow rate) characteristic of the liquid delivery device 100 illustrated in FIG. 1.
Figure 6:
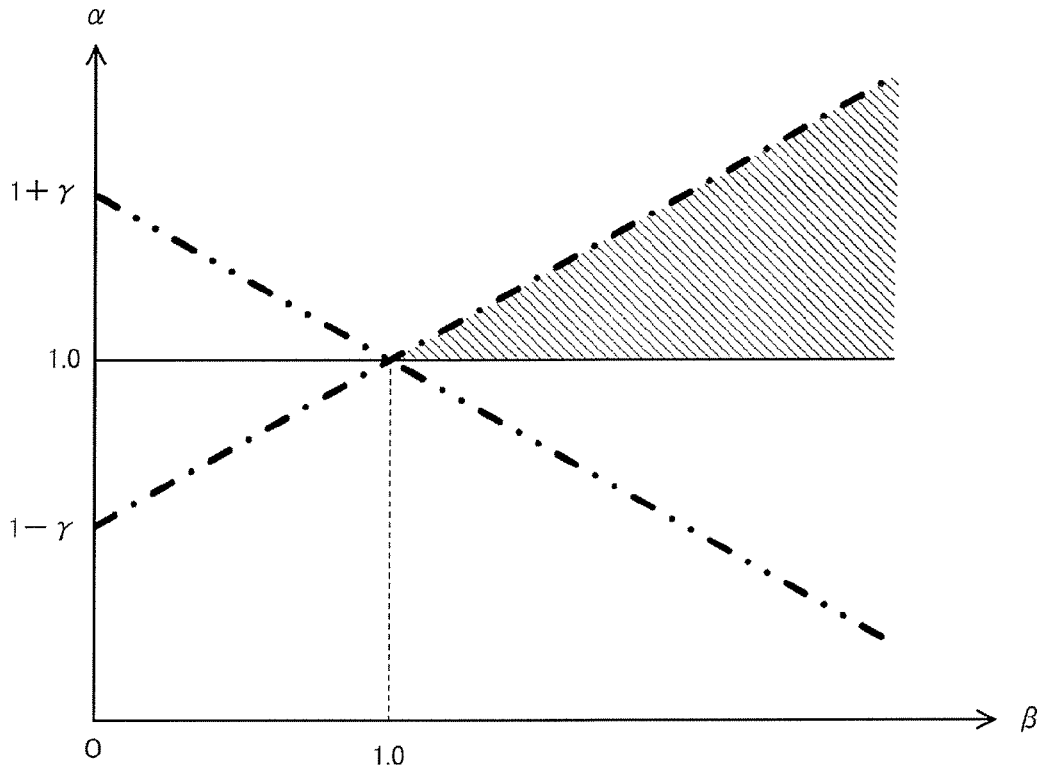
FIG. 6 illustrates a relationship between $\alpha$, $\beta$ and $\gamma$ in the liquid delivery device 100 illustrated in FIG. 1.

FIG. 4 illustrates a P-Q (pressure-flow rate) characteristic of the pump 104 illustrated in FIG. 1. FIG. 5 illustrates a P-Q (pressure-flow rate) characteristic of the liquid delivery device 100 illustrated in FIG. 1. FIG. 6 illustrates the relationship between α, β and γ in the liquid delivery device 100 illustrated in FIG. 1.

In the liquid delivery device 100, a constant flow rate occurs in a range where the pressure $P_O$ applied to the inner region area $S_O$ of the diaphragm 120 is $0 \leq P_O < P_S$ (that is, a range in which, in a state where the pump 104 is being driven, an operation in which the constant flow valve 103 goes from a closed state to an open state and from an open state to closed state is repeatedly performed).

In the range where $P_S \leq P_O$, the constant flow valve 103 is in a normally open state from the instant when the constant flow valve 103 is opened by the discharge pressure $P_P$ of the pump 104 and the discharge flow rate Q of the liquid delivery device 100 decreases in line with the P-Q characteristic of the pump 104 illustrated in FIG. 4 (refer to the thick solid line in FIG. 5).

The discharge pressure $P_P'$ of the pump 104 when $P_O=0$ is expressed by the below Equation 3 which is derived from Equation 2. In addition, the discharge pressure $P_P''$ of the pump 104 when $P_O=P_S$ is expressed by the below Equation 4 derived from Equation 2.

[Math. 3]

$$P_P''=P_S\times S_S/(S_S-S_O) \quad \text{Equation 3}$$

[Math. 4]

$$P_P'' = P_S \times \frac{S_S}{(S_S - S_O)} - P_S \times \frac{S_O}{(S_S - S_O)} = P_S \quad \text{Equation 4}$$

Then, a ratio $\alpha$ between $P_P'$ and $P_P''$ ($\alpha>1$) is defined by the below Equation 5 derived from Equation 3 and Equation 4.

[Math. 5]

$$\frac{P_P'}{P_P''} = \frac{S_S}{(S_S - S_O)} = \alpha \quad \text{Equation 5}$$

In addition, as illustrated in FIG. 4, the P-Q characteristic of the pump 104 is represented by the below Equation 6 where the discharge pressure of the pump 104 when the discharge flow rate of the pump 104 is zero (that is, the maximum discharge pressure) is denoted by $P_1$, and the flow rate of the pump 104 when the discharge pressure of the pump 104 is zero (time of no load) (that is, maximum flow rate) is denoted by $Q_1$.

[Math. 6]

$$Q=(Q_1/P_1)P+Q_1 \quad \text{Equation 6}$$

Here, when Equation 3 and Equation 5 are substituted into Equation 6, a flow rate Q' is expressed by the below Equation 7. Similarly, when Equation 4 and Equation 5 are substituted into Equation 6, a flow rate Q" is expressed by the below Equation 8.

[Math. 7]

$$Q'=(-Q_1/P_1)\alpha P_S+Q_1 \quad \text{Equation 7}$$

[Math. 8]

$$Q''=(-Q_1/P_1)P_S+Q_1 \quad \text{Equation 8}$$

The ratio between Q' and Q" is expressed by the below Equation 9 derived from Equation 7 and Equation 8.

[Math. 9]

$$\begin{aligned}\frac{Q'}{Q''} &= \frac{\left\{\left(-\frac{Q_1}{P_1}\right)\alpha P_S + Q_1\right\}}{\{(-Q_1/P_1)P_S + Q_1\}} \\ &= (-Q_1\alpha P_S + P_1Q_1)/(-Q_1P_S + P_1Q_1) \\ &= (P_1 - \alpha P_S)/(P_1 - P_S)\end{aligned} \quad \text{Equation 9}$$

Here, when $P_1$ is defined as $P_1=\beta P_S$ ($\beta>1$) and substituted into Equation 9, the below Equation 10 is obtained. Since the constant flow valve 103 is not open and liquid cannot be delivered when $\beta>1$, at which $P_1$ is lower than $P_S$, it is necessary that $\beta>1$.

[Math. 10]

$$\frac{Q'}{Q''} - (P_1 - \alpha P_S)/(P_1 - P_S) = (\beta - \alpha)/(\beta - 1) \quad \text{Equation 10}$$

Here, if $Q'/Q''\approx 1$, even if the pressure $P_O$ applied to the inner region area $S_O$ of the diaphragm 120 varies in the range from 0 to below $P_S$, the flow rate of the medicinal solution supplied to the liquid consumption unit 109 is substantially constant. That is, in the case where the needed flow rate accuracy is $\gamma$% ($\gamma>0$), if Q'/Q" of Equation 10 is $1-\gamma\leq(Q'/Q'')\leq 1+\gamma$, even if the pressure $P_O$ applied to the inner region area $S_O$ of the diaphragm 120 varies in the range from 0 to below $P_S$, the flow rate of the medicinal solution supplied to the liquid consumption unit 109 is constant.

Accordingly, if the equations $1-\gamma\leq(\beta-\alpha)/(\beta-1)$ and $1+\gamma\geq(\beta-\alpha)/(\beta-1)$ are computed, the below Equation 11 and Equation 12 are obtained.

[Math. 11]

$$\alpha\leq\beta\gamma-\gamma+1 \quad \text{Equation 11}$$

[Math. 12]

$$\alpha\geq-\beta\gamma+\gamma+1 \quad \text{Equation 12}$$

Here, since $\alpha>1$ due to the structure of the constant flow valve 103 as described above, the below Equation 13 is obtained from Equation 11 and Equation 12.

[Math. 13]

$$1<\alpha\leq\beta\gamma-\gamma+1 \quad \text{Equation 13}$$

From Equation 13, the range of $\alpha$ and $\beta$, that is, the range of "$S_S/(S_S-S_O)$" and "$P_1/P_S$" is the region indicated by diagonal shading in FIG. 6. An example of a P-Q characteristic of the liquid delivery device 100 that satisfies this (value of discharge flow rate Q of liquid delivery device 100 with respect to change in value of $P_O$) is expressed by the solid line in FIG. 5. In addition, a lower limit case that satisfies $1<\alpha\leq\beta\gamma-\gamma+1$ is $\alpha=\beta\gamma-\gamma+1$ and is expressed by the one-dot dashed line in FIG. 5.

Here, the example of $\alpha>\beta\gamma+1$ is expressed by the two-dot dashed line in FIG. 5. In this case, in the range where the pressure $P_O$ applied to the inner region area $S_O$ of the diaphragm 120 is $0\leq P_O<P_S$, the change in the discharge flow rate Q is larger than the above-mentioned flow rate accuracy $\gamma$% and the discharge flow rate Q of the liquid delivery device 100 is not constant.

However, in the case where $1<\alpha\leq\beta\gamma-\gamma+1$ is satisfied, in the range where the pressure $P_O$ applied to the inner region area $S_O$ of the diaphragm 120 is $0\leq P_O<P_S$, the change in the discharge flow rate Q is smaller than the above-mentioned flow rate accuracy $\gamma$% and the discharge flow rate Q of the liquid delivery device 100 is constant.

Therefore, in the liquid delivery device 100, the constant flow valve 103 is provided such that the relationship $1<\alpha\leq\beta\gamma-\gamma+1$ is satisfied and therefore in the range in which the pressure $P_O$ applied to the inner region area $S_O$ of the diaphragm 120 is $0\leq P_O<P_S$, the discharge flow rate Q is constant.

For example, if the liquid delivery device 100 is a liquid delivery device for which the needed flow rate accuracy is 10% and that is equipped with a pump 104 for which $P_1$=300 [kPa] and a constant flow valve 103 for which $P_S$=10 [kPa], β=30 and therefore $1<\alpha\leq3.9$ from Equation 13. Consequently, if the constant flow valve 103 is provided such that the relationship $1<\alpha\leq3.9$ is satisfied, the discharge flow rate Q of the liquid delivery device 100 in a range in which the pressure $P_O$ applied to the inner region area $S_O$ of the diaphragm 120 is $0\leq P_O<P_S$ is constant.

The change in the flow rate becomes smaller the closer α comes to 1. That is, the larger $S_S$ is made or the smaller $S_O$ is made, or the larger $P_1$ is made compared to $P_S$, the smaller the change in flow rate becomes.

Therefore, with the liquid delivery device 100 of this embodiment, it is possible to make the flow rate of the medicinal solution supplied to the liquid consumption unit 109 stable even if a change occurs in the surrounding environment of the liquid delivery device 100.

Second Embodiment of Present Invention

Figure 7:
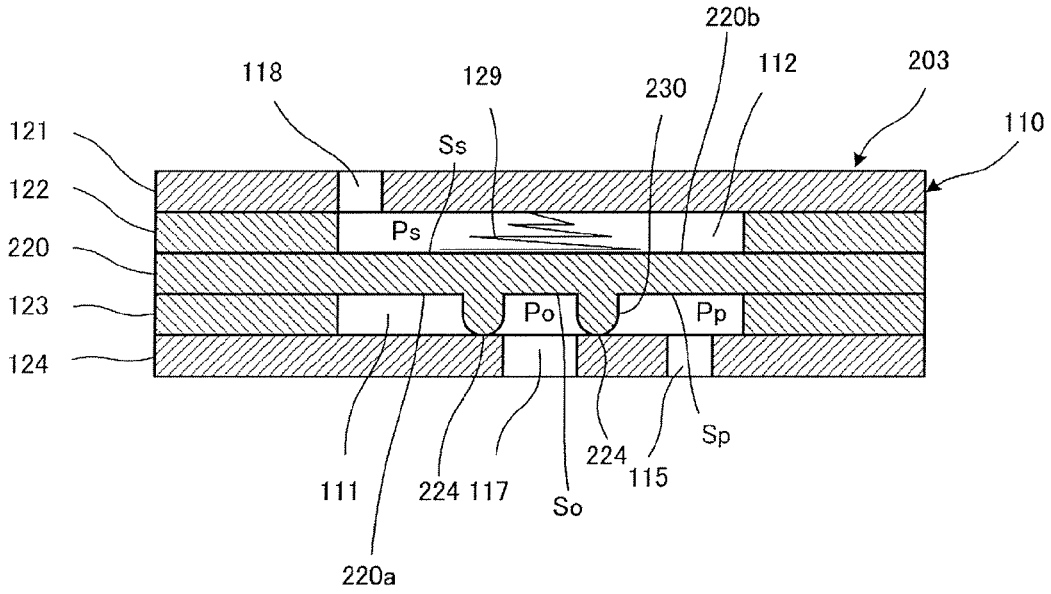
FIG. 7 is a sectional view of a constant flow valve 203 provided in a liquid delivery device according to a second embodiment of the present invention.

FIG. 7 is a sectional view of a constant flow valve 203 provided in a liquid delivery device according to a second embodiment of the present invention.

In the constant flow valve 103 of the liquid delivery device 100 of the first embodiment, the O-ring 130 serving as a valve seat is provided, whereas in the constant flow valve 203 of the liquid delivery device of the second embodiment, the O-ring 130 is not provided and a peripheral portion of the second opening 117 of the valve casing 110 that a diaphragm 220 contacts at a valve closed time serves as a valve seat 224. The diaphragm 220 is integrally provided with a ring-shaped protruding portion 230 that contacts the valve seat 224. The rest of the configuration of the liquid delivery device of the second embodiment is the same as that of the liquid delivery device 100 of the first embodiment.

Consequently, as illustrated in FIG. 7, the constant flow valve 203 is provided such that the relationship $1<\alpha\leq\beta\gamma-\gamma+1$ is satisfied in the range $0\leq P_O<P_S$, when an outer region area of the diaphragm 220 positioned outside of the protruding portion 230 at a valve closed time out of a first main surface 220*a* of the diaphragm 220 that faces the first valve chamber 111 is denoted $S_P$, the area of a second main surface 220*b* of the diaphragm 220 that faces the second valve chamber 112 is denoted $S_S$, the discharge pressure of the pump 104 applied to the outer region area $S_S$ of the diaphragm 220 is denoted $P_P$, a pressurizing force of the spring 129 applied to the area $S_S$ of the second main surface 220*b* of the diaphragm 220 is denoted $P_S$, the pressure applied to the inner region area $S_O$ of the diaphragm 220 positioned inside of the protruding portion 230 at a valve closed time out of the first main surface 220*a* of the diaphragm 220 that faces the first valve chamber 111 is denoted $P_O$, the discharge pressure of the pump 104 when the discharge flow rate of the pump 104 is zero is denoted $P_1$, $S_S/S_P$ is denoted α (α>1), $P_1/P_S$ is denoted β (β>1), and the flow rate accuracy is denoted γ%.

Therefore, with the liquid delivery device of the second embodiment, the same operational effect is obtained as with the liquid delivery device 100 of the first embodiment. In addition, with the liquid delivery device of the second embodiment, since the manufacturing step for providing the O-ring 130 is not necessary, the manufacturing cost can be reduced.

Third Embodiment of Present Invention

Figure 8:
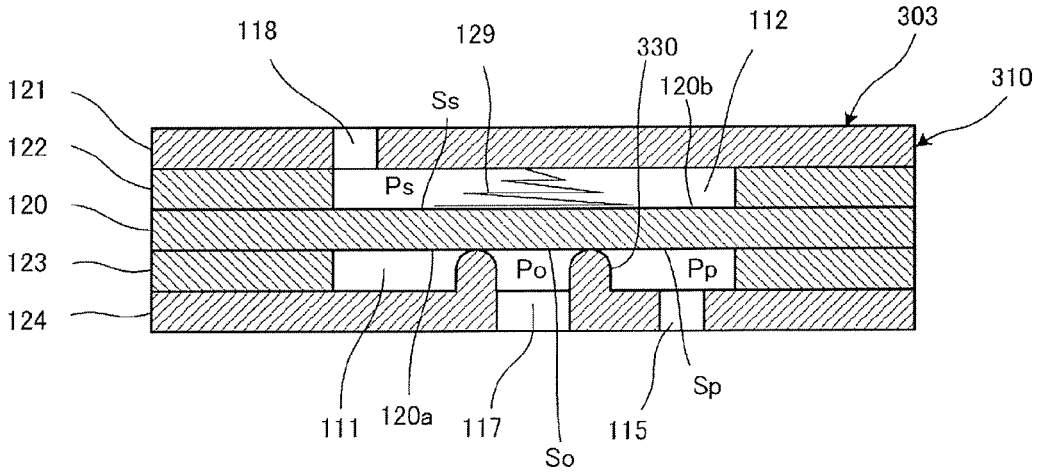
FIG. 8 is a sectional view of a constant flow valve 303 provided in a liquid delivery device according to a third embodiment of the present invention.

FIG. 8 is a sectional view of a constant flow valve 303 provided in a liquid delivery device according to a third embodiment of the present invention.

The liquid delivery device of the third embodiment differs from the liquid delivery device 100 of the first embodiment in that a ring-shaped valve seat 330 is provided in the constant flow valve 303 so as to be integrated with a valve casing 310. The rest of the configuration of the liquid delivery device of the third embodiment is the same as that of the liquid delivery device 100 of the first embodiment.

Consequently, as illustrated in FIG. 8, the constant flow valve 303 is provided such that the relationship $1<\alpha\leq\beta\gamma-\gamma+1$ is satisfied in the range $0\leq P_O<P_S$ when an outer region area of the diaphragm 120 positioned outside of a region in contact with the valve seat 330 at a valve closed time out of the first main surface 120*a* of the diaphragm 120 that faces the first valve chamber 111 is denoted $S_P$, the area of the second main surface 120*b* of the diaphragm 120 that faces the second valve chamber 112 is denoted $S_S$, the discharge pressure of the pump 104 applied to the outer region area $S_P$ of the diaphragm 120 is denoted $P_P$, a pressurizing force of the spring 129 applied to the area $S_S$ of the second main surface 120*b* of the diaphragm 120 is denoted $P_S$, the pressure applied to the inner region area $S_O$ of the diaphragm 120 positioned inside of the region in contact with the valve seat 330 at a valve closed time out of the first main surface 120*a* of the diaphragm 120 that faces the first valve chamber 111 is denoted $P_O$, the discharge pressure of the pump 104 when the discharge flow rate of the pump 104 is zero is denoted $P_1$, $S_S/S_P$ is denoted α (α>1), $P_1/P_S$ is denoted β (β>1), and the flow rate accuracy is denoted γ%.

Therefore, with the liquid delivery device of the third embodiment, the same operational effect as with the liquid delivery device 100 of the first embodiment is obtained. In addition, with the liquid delivery device of the third embodiment, since the manufacturing step for providing the O-ring 130 is not necessary, the manufacturing cost can be reduced.

Fourth Embodiment of Present Invention

Figure 9:
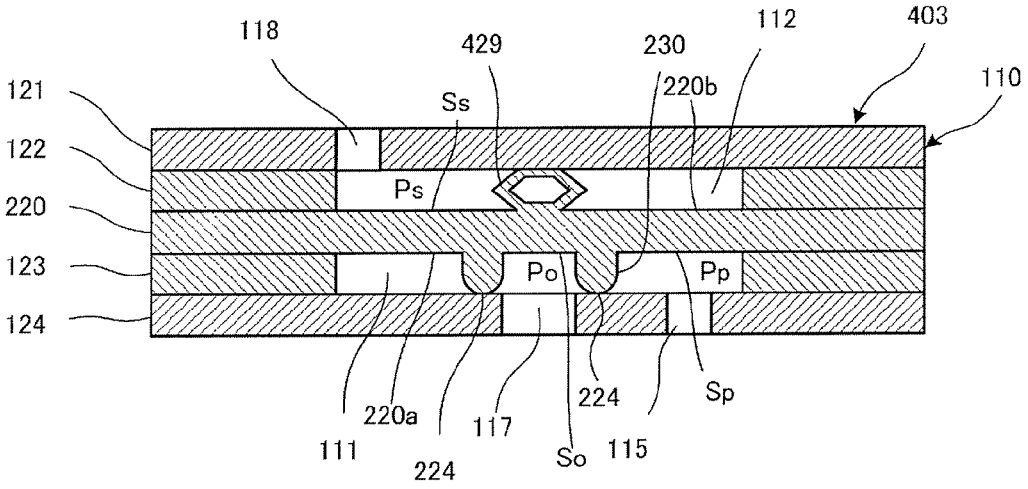
FIG. 9 is a sectional view of a constant flow valve 403 provided in a liquid delivery device according to a fourth embodiment of the present invention.

FIG. 9 is a sectional view of a constant flow valve 403 provided in a liquid delivery device according to a fourth embodiment of the present invention.

The liquid delivery device of the fourth embodiment differs from the liquid delivery device of the second embodiment in that a spring portion 429 is provided in the constant flow valve 403 so as to be integrated with the diaphragm 220. The rest of the configuration of the liquid delivery device of the fourth embodiment is the same as that of the liquid delivery device of the second embodiment.

Consequently, as illustrated in FIG. 9, the constant flow valve 403 is provided such that the relationship $1<\alpha\leq\beta\gamma-\gamma+1$ is satisfied in the range $0\leq P_O<P_S$ when an outer region area of the diaphragm 220 positioned outside of the protruding portion 230 at a valve closed time out of the first main surface 220*a* of the diaphragm 220 that faces the first valve chamber 111 is denoted $S_P$, the area of the second main surface 220*b* of the diaphragm 220 that faces the second valve chamber 112 is denoted $S_S$, the discharge pressure of the pump 104 applied to the outer region area $S_P$ of the diaphragm 220 is denoted $P_P$, a pressurizing force of the spring portion 429 applied to the area $S_S$ of the second main surface 220*b* of the diaphragm 220 is denoted $P_S$, the pressure applied to the inner region area $S_O$ of the diaphragm 220 positioned inside of the protruding portion 230 at a valve closed time out of the first main surface 220*a* of the diaphragm 220 that faces the first valve chamber 111 is denoted $P_O$, the discharge pressure of the pump 104 when the discharge flow rate of the pump 104 is zero is denoted $P_1$, $S_S/S_P$ is denoted α (α>1), $P_1/P_S$ is denoted β (β>1), and the flow rate accuracy is denoted γ%.

Therefore, with the liquid delivery device of the fourth embodiment, the same operational effect as with the liquid delivery device of the second embodiment is obtained. In addition, with the liquid delivery device of the fourth embodiment, since the manufacturing step for providing the spring 129 is not necessary, the manufacturing cost can be reduced.

Fifth Embodiment of Present Invention

Figure 10:
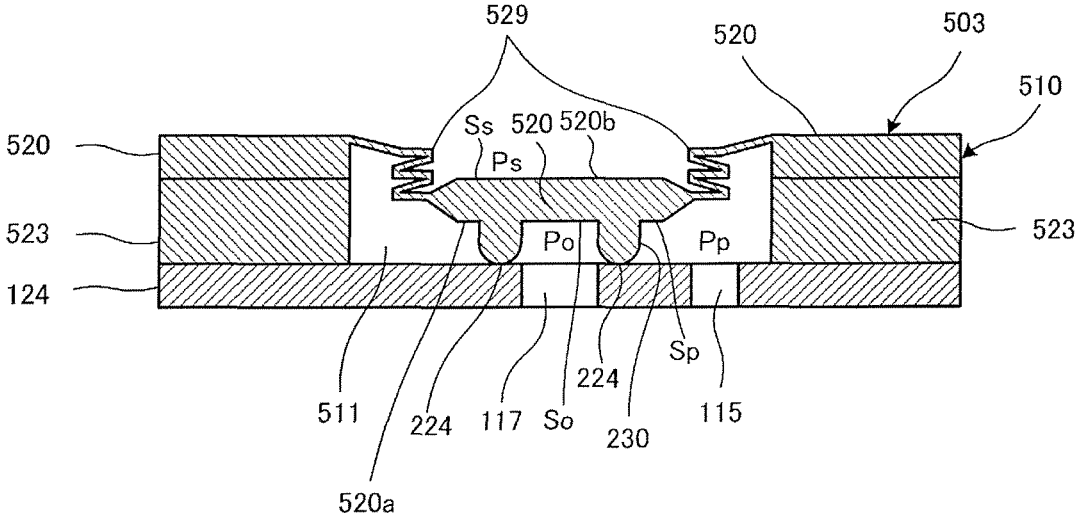
FIG. 10 is a sectional view of a constant flow valve 503 provided in a liquid delivery device according to a fifth embodiment of the present invention.

FIG. 10 is a sectional view of a constant flow valve 503 provided in a liquid delivery device according to a fifth embodiment of the present invention.

The liquid delivery device of the fifth embodiment differs from the liquid delivery device of the second embodiment in that a spring portion 529 is provided in the constant flow valve 503 so as to be integrated with a diaphragm 520, and in that the second valve chamber 112 is not provided. That is, the constant flow valve 503 includes a diaphragm 520 that has a first main surface 520*a* that faces the first opening 115 and the second opening 117 and a second main surface 520*b* that is on the opposite side to the first main surface 520*a* and is in contact with a space outside of a valve casing 510, and that forms together with the valve casing 510 a first valve chamber 511 that is provided on the first main surface 520*a* side. The second main surface 520*b* is exposed to the space outside the constant flow valve 503. The rest of the configuration of the liquid delivery device of the fifth embodiment is the same as that of the liquid delivery device of the second embodiment.

In addition, in the constant flow valve 503 of the fifth embodiment, a side plate 523 that is thicker than the side plate 123 of the constant flow valve 203 of the second embodiment is used. Consequently, in the liquid delivery device of the fifth embodiment, the first valve chamber 511 of the constant flow valve 503 is wider than the first valve chamber 111 of the constant flow valve 203 of the second embodiment, but the operational effect is the same as that with the liquid delivery device of the second embodiment.

In addition, with the liquid delivery device of the fifth embodiment, since the manufacturing step for providing the spring 129 is not necessary, the manufacturing cost can be further reduced. In addition, in the liquid delivery device of the fifth embodiment, since the second valve chamber 112 is not provided, it is possible to reduce the profile of the constant flow valve 503.

Sixth Embodiment of Present Invention

Figure 11:
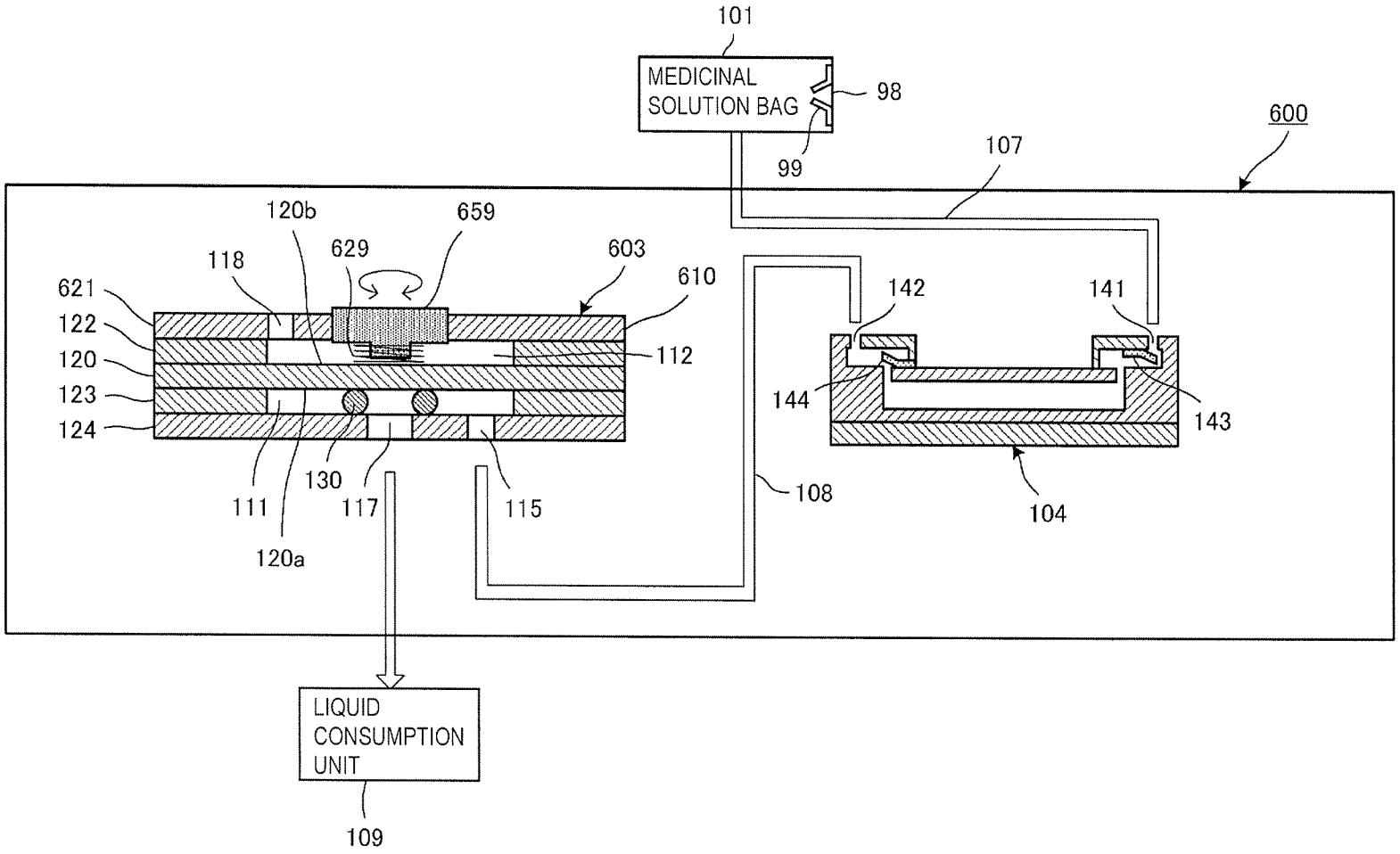
FIG. 11 is an outline structural view of a liquid delivery device 600 according to a sixth embodiment of the present invention.
Figure 12:
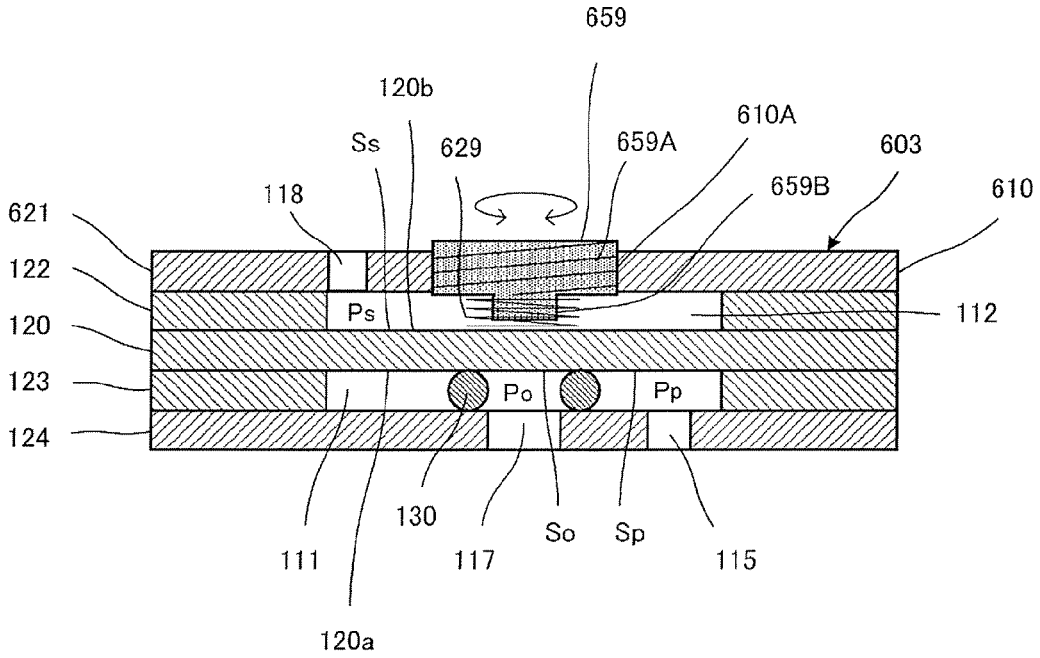
FIG. 12 is a sectional view of a constant flow valve 603 provided in the liquid delivery device 600 illustrated in FIG. 11.
Figure 13:
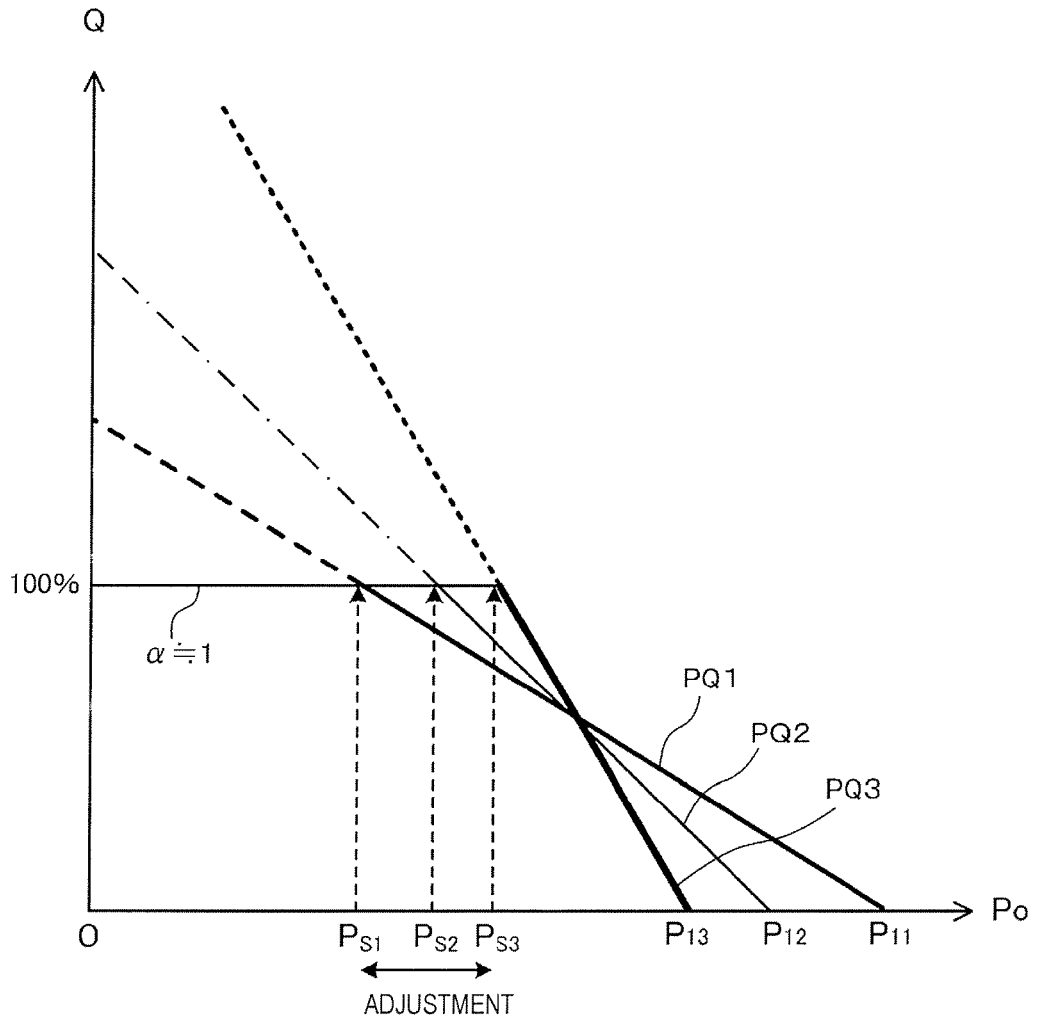
FIG. 13 illustrates a P-Q (pressure-flow rate) characteristic of the liquid delivery device 600 illustrated in FIG. 11.

FIG. 11 is an outline structural view of a liquid delivery device 600 according to a sixth embodiment of the present invention. FIG. 12 is a sectional view of a constant flow valve 603 provided in the liquid delivery device 600 illustrated in FIG. 11. FIG. 13 illustrates a P-Q (pressure-flow rate) characteristic of the liquid delivery device 600 illustrated in FIG. 11.

As illustrated in FIG. 11 and FIG. 12, the liquid delivery device 600 of the sixth embodiment differs from the liquid delivery device 100 of the first embodiment in that it includes a spring 629 and a pressing body 659 in the constant flow valve 603. The rest of the configuration of the constant flow valve 603 is the same as that of the constant flow valve 103 illustrated in FIG. 1.

A valve casing 610 is formed of a top plate 621 in which a fourth opening 610A is formed, the side plate 122, the side plate 123 and the bottom plate 124. The top plate 621 is a plate obtained by forming the third opening 118 and the fourth opening 610A in the top plate 121. A thread groove is formed around the inner periphery of the fourth opening 610A.

The pressing body 659 has a screw thread on a top portion 659A thereof and the top portion 659A of the pressing body 659 is screwed into the fourth opening 610A of the valve casing 610. In addition, a shaft 659B of the pressing body 659 is inserted into a cylindrical spring 629.

The material of the spring 629 is the same as that of the spring 129 and for example is a metal or an elastomer. The spring 629 is a compression coil spring.

In the second valve chamber 112, the spring 629 is provided so as to be in contact with the surface of the top portion 659A of the pressing body 659 on the O-ring 130 side and so as to be in contact with the second main surface 120*b* of the diaphragm 120. The spring 629 is urged by the pressing body 659 toward the O-ring 130 side. The spring 629 applies a pressure toward the O-ring 130 side to the second main surface 120*b* of the diaphragm 120.

In addition, although the spring 629 is formed of a compression coil spring in this embodiment, the embodiment is not limited to this. At the time of implementation, the spring 629 may be for example formed of a plate spring.

As illustrated in FIG. 11, the constant flow valve 603 is provided such that the relationship $1<\alpha\leq\beta\gamma-\gamma+1$ is satisfied in the range $0\leq P_O<P_S$ when an outer region area of the diaphragm 120 positioned outside of the region contacting the O-ring 130 at a valve closed time out of the first main surface 120*a* of the diaphragm 220 that faces the first valve chamber 111 is denoted $S_P$, the area of the second main surface 120*b* of the diaphragm 120 that faces the second valve chamber 112 is denoted $S_S$, the discharge pressure of the pump 104 applied to the outer region area $S_P$ of the diaphragm 120 is denoted $P_P$, a pressurizing force of the spring 629 applied to the area $S_S$ of the second main surface 120*b* of the diaphragm 120 is denoted $P_S$, the pressure applied to the inner region area $S_O$ of the diaphragm 120 positioned inside of the region contacting the O-ring 130 at a valve closed time out of the first main surface 120*a* of the diaphragm 220 that faces the first valve chamber 111 is denoted $P_O$, the discharge pressure of the pump 104 when the discharge flow rate of the pump 104 is zero is denoted $P_1$, $S_S/S_P$ is denoted α (α>1), $P_1/P_S$ is denoted β (β>1), and the flow rate accuracy is denoted γ%.

Therefore, with the liquid delivery device 600 of the sixth embodiment, the same operational effect as with the liquid delivery device 100 of the first embodiment is obtained.

Here, the constant flow valve 603 includes an adjustment mechanism with which it is possible to adjust the pressurizing force $P_S$ toward the O-ring 130 side applied to the second main surface 120*b* of the diaphragm 120. The adjustment mechanism of the constant flow valve 603 is formed by the spring 629 and the pressing body 659. The pressing body 659 is provided in the valve casing 610 so as to be freely rotatable by screwing of a screw having an axis of rotation in a direction orthogonal to the diaphragm 120. With the adjustment mechanism, the distance between the pressing body 659 and the diaphragm 120 is determined by the rotation of the pressing body 659.

In more detail, in the constant flow valve 603, when the pressing body 659 having the screw thread on the top portion 659A thereof is rotated clockwise, the pressing body 659 moves closer to the O-ring 130 while compressing the spring 629. That is, the pressurizing force $P_S$ toward the O-ring 130 side that is applied to the second main surface 120*b* of the diaphragm 120 becomes larger. On the other hand, when the pressing body 659 is rotated anticlockwise, the pressing body 659 moves away from the O-ring 130 while releasing the spring 629. That is, the pressurizing force $P_S$ toward the O-ring 130 side that is applied to the second main surface 120*b* of the diaphragm 120 becomes smaller.

Accordingly, in the constant flow valve 603, it is possible to adjust the pressurizing force $P_S$ toward the O-ring 130 side that is applied to the second main surface 120*b* of the diaphragm 120 by rotating the pressing body 659.

Hereafter, the method of adjusting the pressurizing force $P_S$ toward the O-ring 130 side that is applied to the second main surface 120*b* of the diaphragm 120 will be described in detail. First, the PQ characteristic of the pump 104 is measured before connecting the pump 104 and the constant flow valve 603 to each other. Next, the value of the pressurizing force of the constant flow valve 603 that is required in order to make the entirety of the liquid delivery device 600 have a certain flow rate is calculated on the basis of the measured PQ characteristic of the pump 104. Then, the pressing body 659 is rotated and the pressurizing force $P_S$ of the constant flow valve 603 is adjusted to the calculated value. Once the pressurizing force $P_S$ has been adjusted, the pressing body 659 is fixed in place so as not to rotate by using for example an adhesive.

Accordingly, for example, as illustrated in FIG. 13, even if three pumps 104 have different PQ characteristics PQ1 to PQ3 due to variations in the manufacture of the pumps 104, the pressurizing force $P_S$ can be adjusted to any of $P_{S1}$ to $P_{S3}$ in accordance with the different PQ characteristics of the pumps 104 connected to the constant flow valves 603.

Similarly, even if there are individual differences in the characteristics of a plurality of constant flow valves 603 due to for example variations in the manufacture of the constant flow valves 603, the pressurizing force $P_S$ can be adjusted to a certain pressure in accordance with the individual differences of the constant flow valves 603.

Therefore, even if there are individual differences in pumps 104 and constant flow valves 603 due to for example variations in the manufacture of the pumps 104 and the constant flow valves 603, the discharge flow rate Q of the entire liquid delivery device 600 can be adjusted to a certain flow rate in accordance with the individual differences of the pump 104 and the constant flow valve 603 via the adjustment mechanism of the constant flow valve 603. That is, with the liquid delivery device 600, the discharge flow rate Q of the liquid delivery device 600 can be made to be constant.

Here, for example, the following modifications of the adjustment mechanism described in the sixth embodiment of the present invention can be adopted.

<<First Modification>>

Figure 14:
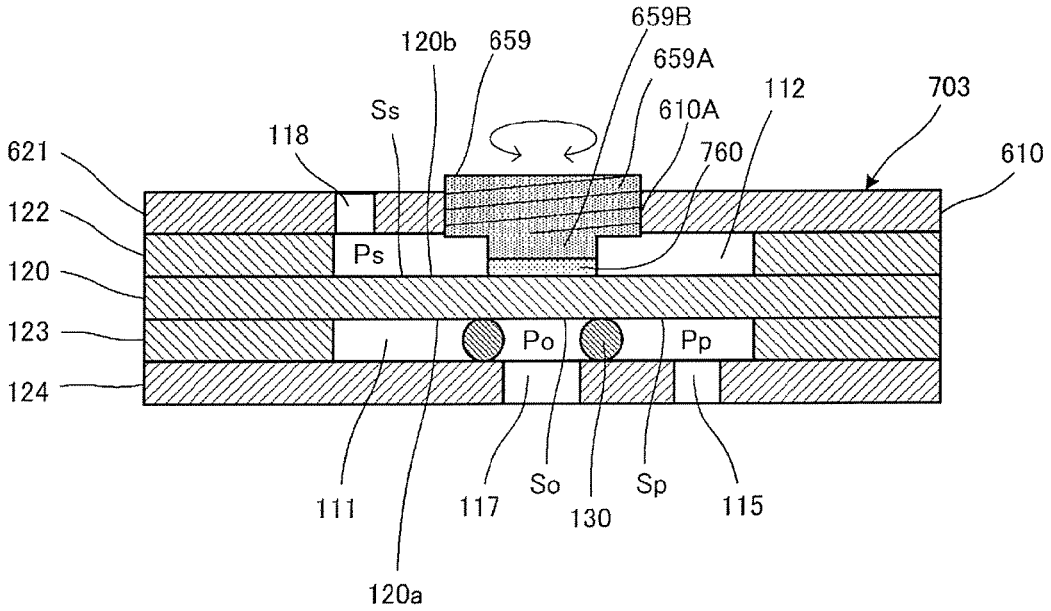
FIG. 14 is a sectional view of a constant flow valve 703 according to a first modification of the constant flow valve 603 illustrated in FIG. 11.

FIG. 14 is a sectional view of a constant flow valve 703 according to a first modification of the constant flow valve 603 illustrated in FIG. 11.

The constant flow valve 703 differs from the constant flow valve 603 in that an elastic member 760 is provided instead of the spring 629. That is, the adjustment mechanism of the constant flow valve 703 is formed by the elastic member 760 and the pressing body 659. The rest of the configuration of the constant flow valve 703 is the same as that of the constant flow valve 603.

In more detail, the elastic member 760 is provided between and so as to contact the shaft 659B of the pressing body 659 and the second main surface 120*b* of the diaphragm 120. Consequently, the elastic member 760 is urged toward the O-ring 130 side by the pressing body 659. The elastic member 760 applies a pressure toward the O-ring 130 side to the second main surface 120*b* of the diaphragm 120. The material of the elastic member 760 is a vulcanized rubber such as silicone rubber or a ethylene propylene diene monomer (EPDM).

In the constant flow valve 703, when the pressing body 659 having a screw thread on the top portion 659A thereof is rotated clockwise, the pressing body 659 moves closer to the O-ring 130 while compressing the elastic member 760. That is, the pressurizing force $P_S$ toward the O-ring 130 side that is applied to the second main surface 120*b* of the diaphragm 120 becomes larger. On the other hand, when the pressing body 659 is rotated anticlockwise, the pressing body 659 moves away from the O-ring 130 while releasing the elastic member 760. That is, the pressurizing force $P_S$ toward the O-ring 130 side that is applied to the second main surface 120*b* of the diaphragm 120 becomes smaller.

Therefore, also in the constant flow valve 703, the pressurizing force $P_S$ toward the O-ring 130 side that is applied to the second main surface 120*b* of the diaphragm 120 can be adjusted.

In addition, in this modification, although the elastic member 760 is composed of vulcanized rubber, the modification is not limited to this. At the time of implementation, the elastic member 760 may be composed of for example a resin having low elasticity such as polyethylene or a thermoplastic elastomer.

<<Second Modification>>

Figure 15:
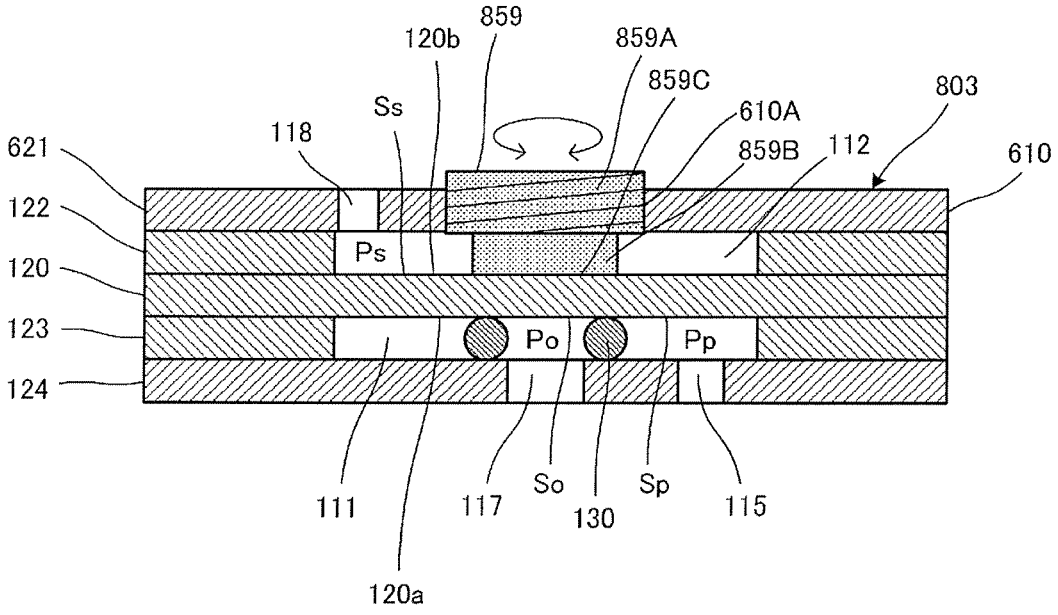
FIG. 15 is a sectional view of a constant flow valve 803 according to a second modification of the constant flow valve 603 illustrated in FIG. 11.

FIG. 15 is a sectional view of a constant flow valve 803 according to a second modification of the constant flow valve 603 illustrated in FIG. 11.

The constant flow valve 803 differs from the constant flow valve 603 in that a pressing body 859 is provided instead of the spring 629 and the pressing body 659. That is, the adjustment mechanism of the constant flow valve 803 is formed of only the pressing body 859. The rest of the configuration of the constant flow valve 803 is the same as that of the constant flow valve 603.

In more detail, the pressing body 859 has a screw thread on a top portion 859A thereof and the top portion 859A of the pressing body 859 is screwed into the fourth opening 610A of the valve casing 610. In addition, a leading end 859C of a shaft 859B of the pressing body 859 contacts the second main surface 120*b* of the diaphragm 120.

The pressing body 859 applies a pressure toward the O-ring 130 side to the second main surface 120*b* of the diaphragm 120. The material of the pressing body 859 is composed of a vulcanized rubber such as silicone rubber or a ethylene propylene diene monomer (EPDM).

Consequently, in the constant flow valve 803, when the pressing body 859 having a screw thread on the top portion 859A thereof is rotated clockwise, the entire pressing body 859 moves closer to the O-ring 130 while being compressed. That is, the pressurizing force $P_S$ toward the O-ring 130 side that is applied to the second main surface 120*b* of the diaphragm 120 becomes larger. On the other hand, when the pressing body 859 is rotated anticlockwise, the entire pressing body 859 moves away from the O-ring 130 while expanding. That is, the pressurizing force $P_S$ toward the O-ring 130 side that is applied to the second main surface 120*b* of the diaphragm 120 becomes smaller.

Therefore, also in the constant flow valve 803, the pressurizing force $P_S$ toward the O-ring 130 side that is applied to the second main surface 120*b* of the diaphragm 120 can be adjusted.

In addition, in this modification, although the pressing body 859 is composed of vulcanized rubber, the modification is not limited to this. At the time of implementation, the pressing body 859 may be composed of for example a resin having low elasticity such as polyethylene or a thermoplastic elastomer.

<<Third Modification>>

Figure 16:
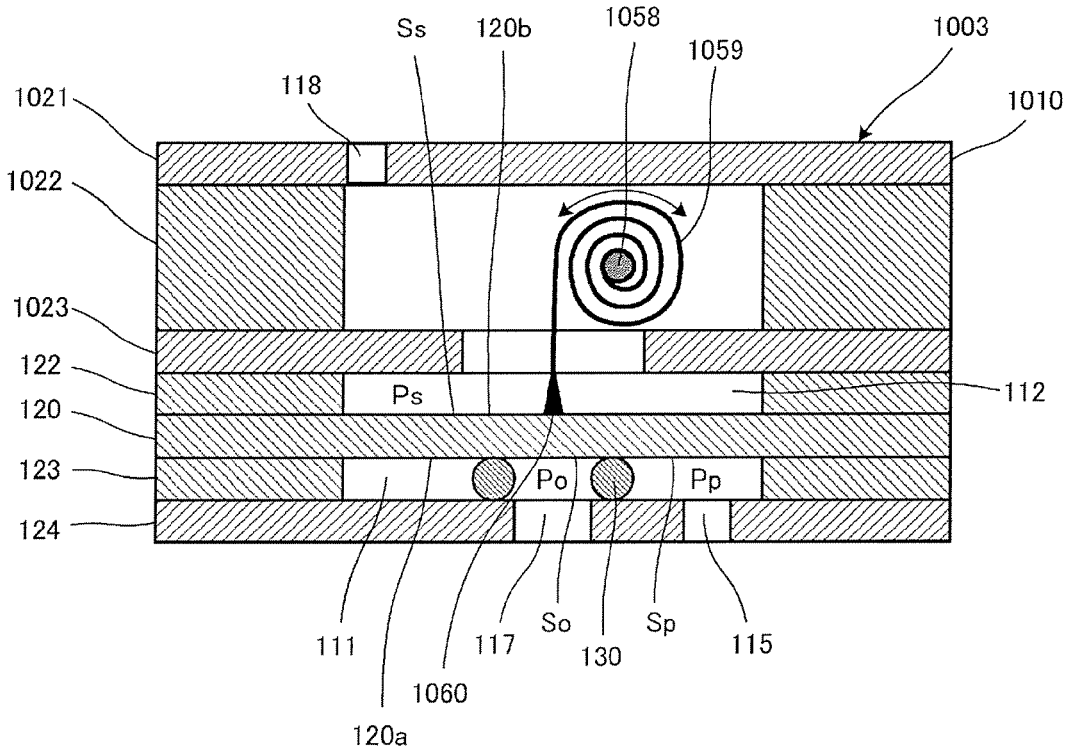
FIG. 16 is a sectional view of a constant flow valve 1003 according to a third modification of the constant flow valve 603 illustrated in FIG. 11.
Figure 17:
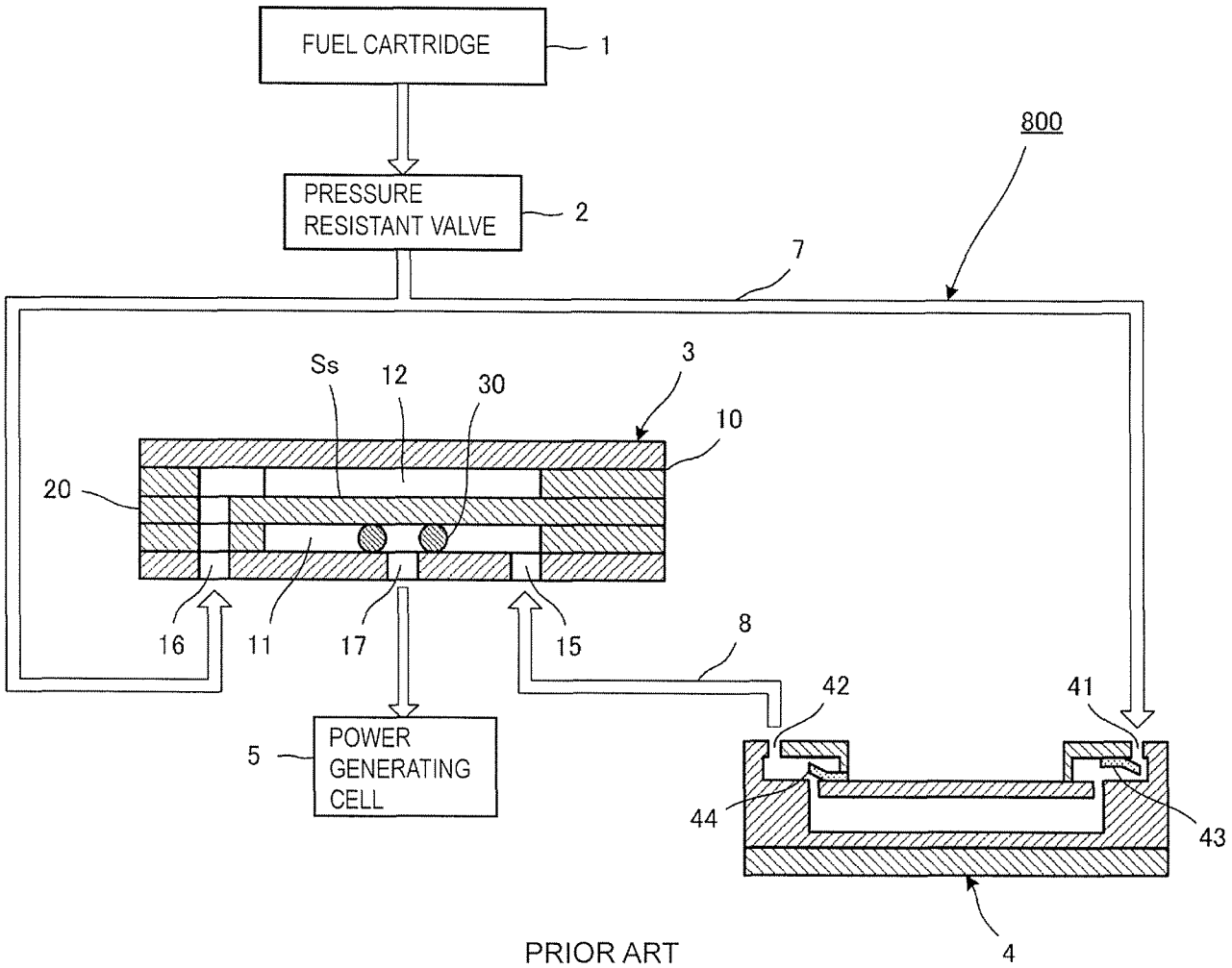
FIG. 17 is a outline structural view of a liquid delivery device 800 described in Patent Document 1.
Figure 18:
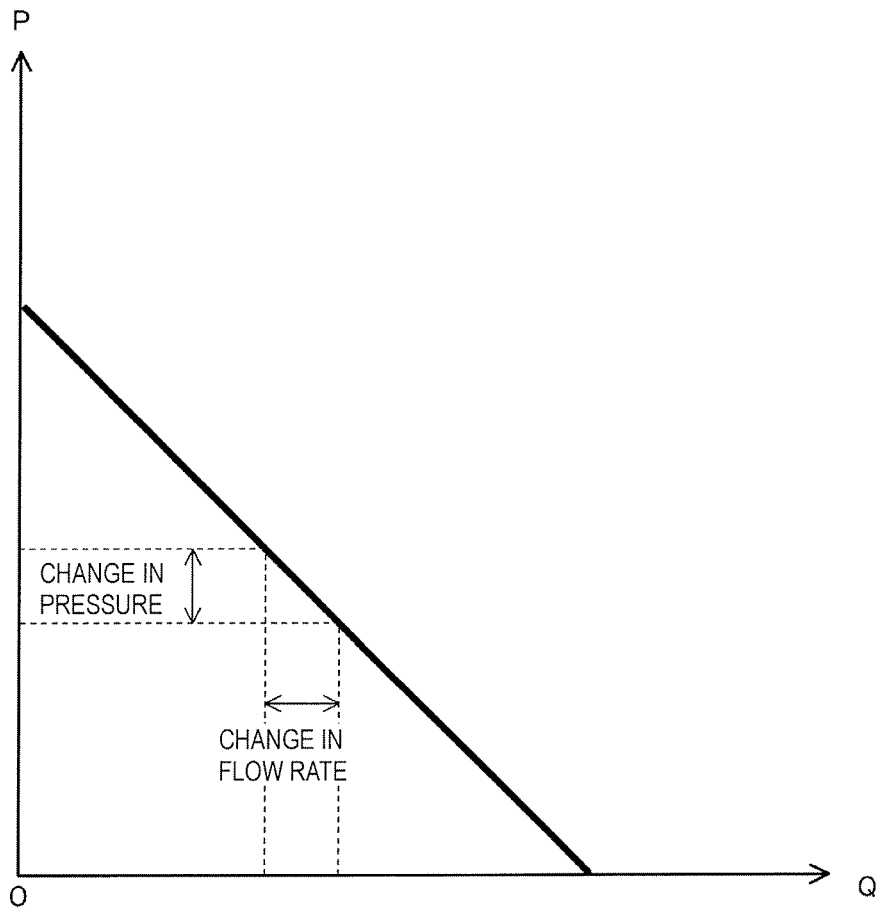
FIG. 18 illustrates a P-Q (pressure-flow rate) characteristic of a pump described in Patent Document 1.

FIG. 16 is a sectional view of a constant flow valve 1003 according to a third modification of the constant flow valve 603 illustrated in FIG. 11.

The constant flow valve 1003 differs from the constant flow valve 603 in that a coil spring 1059 and a rotational shaft 1058 are provided instead of the spring 629 and the pressing body 659. That is, the adjustment mechanism of the constant flow valve 1003 is formed of the coil spring 1059 and the rotational shaft 1058. The rest of the configuration of the constant flow valve 1003 is the same as that of the constant flow valve 603.

In more detail, a valve casing 1010 is formed of a top plate 1021, a side plate 1022, a side plate 1023, the side plate 123 and the bottom plate 124. The side plate 1022 differs from the side plate 122 in that it is thicker than the side plate 122. The side plate 1023 is a plate in which an opening that is circular when viewed in plan has been provided. The side plate 1023 differs from the side plate 122 in that the diameter of the opening in the side plate 1023 is smaller than the diameter of the opening in the side plate 122. The rest of the configuration of the valve casing 1010 is the same as that of the valve casing 610 illustrated in FIG. 13.

The coil spring 1059 is accommodated in a space enclosed by the top plate 1021, the side plate 1022 and the side plate 1023. One end of the coil spring 1059 is fixed to the rotational shaft 1058 and the coil spring 1059 is wound around the rotational shaft 1058. In addition, a mounting portion 1060 provided on the other end of the coil spring 1059 is bonded to the second main surface 120*b* of the diaphragm 120 using for example an adhesive.

The rotational shaft 1058 penetrates through the side plate 1022 and both ends of the rotational shaft 1058 are exposed from the valve casing 1010. Consequently, the coil spring 1059 is rotated by rotation of both ends of the rotational shaft 1058.

The coil spring 1059 applies a pressure toward the O-ring 130 side to the second main surface 120*b* of the diaphragm 120. The material of the coil spring 1059 is the same as that of the spring 629.

Therefore, in the constant flow valve 1003, when the rotational shaft 1058 is rotated clockwise, the coil spring 1059 expands. That is, the pressurizing force $P_S$ toward the O-ring 130 side applied to the second main surface 120*b* of the diaphragm 120 becomes larger. On the other hand, when the rotational shaft 1058 is rotated anticlockwise, the coil spring 1059 contracts. That is, the pressurizing force $P_S$ toward the O-ring 130 side applied to the second main surface 120*b* of the diaphragm 120 becomes smaller.

Therefore, also in the constant flow valve 1003, the pressurizing force $P_S$ toward the O-ring 130 side applied to the second main surface 120*b* of the diaphragm 120 can be adjusted through rotation of the rotational shaft 1058.

Other Embodiments

In the above-described embodiments, a glucose infusion is used as a liquid, but the embodiments are not limited to this. For example, even if the liquid is another liquid such as insulin this can be applied to the liquid delivery device.

In addition, in the above-described embodiments, the flow rate accuracy γ is 10%, but the embodiments are not limited to this. For example, the flow rate accuracy γ may be 5%, 15% or 20%.

In addition, in the above-described embodiments, the diaphragm 120 is composed of silicone rubber, but the embodiments are not limited to this. Another material may be used so long as it has flexibility.

Furthermore, in the above-described embodiments, the spring 129 and the spring portions 429 and 529 are used as the pressure-applying portion, but the embodiments are not limited to this. A pressure-applying portion having another configuration may be used as long as it is capable of applying a pressure to the second main surface of the diaphragm.

In addition, in the above-described embodiments, a valve seat is provided around the periphery of the second opening 117, but the embodiments are not limited to this. For example, a valve seat may be provided around the periphery of the first opening 115.

In addition, in the above-described embodiments, the pump 104 is a piezoelectric pump that is equipped with a piezoelectric element composed of a piezoelectric ceramic, but the embodiments are not limited to this.

In addition, in the above-described embodiments, a thread groove is formed around an inner periphery of the fourth opening 610A, the pressing body 659 has a screw thread on the top portion 659A thereof, but the embodiments are not limited to this. Similarly, a thread groove is formed around the inner periphery of the fourth opening 610A and the pressing body 859 has screw thread on the top portion 859A thereof, but the embodiments are not limited to this. For example, a helical thread groove and a helical screw thread may be formed so long as the pressing body may be screwed into fourth opening.

In addition, in the above-described embodiments, the third opening 118 is formed in the top plate 610, but the embodiments are not limited to this. In the case where the pressing bodies 659 and 859 have a screw thread, a space is formed between the screw thread and the thread groove of the fourth opening 610A and this space may serve as the third opening.

In addition, in the above-described embodiments, the adjustment mechanism adjusts the pressure applied to the second main surface 120*b* of the diaphragm 120 by means of a thread groove and a screw thread, but the embodiments are not limited to this. For example, the pressure may be adjusted via fitting together of a convex portion and a concave portion by a cam as in a variable resistor.

The description of the above embodiments is illustrative in all points and should not be thought of as being limiting. The scope of the present invention is described by the claims and not by the above embodiments. In addition, it is intended that equivalents to the claims and all modifications within the scope of the claims be included in the scope of the present invention.

REFERENCE SIGNS LIST

1 . . . fuel cartridge
2 . . . pressure resistant valve
3 . . . passive valve
4 . . . pump
5 . . . power-generating cell
7, 8 . . . channel
10 . . . valve casing
11 . . . first valve chamber

12 . . . second valve chamber
15 . . . first opening
16 . . . second opening
17 . . . third opening
20 . . . diaphragm
30 . . . ring
41 . . . suction aperture
42 . . . discharge aperture
43 . . . check valve
98 . . . opening
99 . . . check valve
100, 600 . . . liquid delivery device
101 . . . medicinal solution bag
103, 203, 303, 403, 503, 603, 703, 803, 1003 . . . constant flow valve
104 . . . pump
107, 108 . . . channel
109 . . . liquid consumption unit
110, 610, 910, 1010 . . . valve casing
111 . . . first valve chamber
112 . . . second valve chamber
115 . . . first opening
117 . . . second opening
118 . . . third opening
120 . . . diaphragm
120*a* . . . first main surface
120*b* . . . second main surface
121 . . . top plate
122, 123 . . . side plate
124 . . . bottom plate
129 . . . spring
130 . . . O-ring
141 . . . suction aperture
142 . . . discharge aperture
143 . . . check valve
220 . . . diaphragm
220*a* . . . first main surface
220*b* . . . second main surface
224 . . . valve seat
230 . . . protruding portion
310 . . . valve casing
330 . . . valve seat
429 . . . spring portion
510 . . . valve casing
511 . . . first valve chamber
520 . . . diaphragm
520*a* . . . first main surface
520*b* . . . second main surface
523 . . . side plate
529 . . . spring portion
610 . . . valve casing
610A . . . fourth opening
629 . . . spring
659 . . . pressing body
760 . . . elastic member
800 . . . liquid delivery device
859 . . . pressing body
912 . . . second valve chamber
920 . . . diaphragm
1021 . . . top plate
1022, 1023 . . . side plate
1058 . . . rotational shaft
1059 . . . coil spring
1060 . . . mounting portion

The invention claimed is:

1. A liquid delivery device comprising:

a pump having a suction aperture and a discharge aperture;

a liquid consumption unit; and a valve including:

a bottom plate with a first opening communicatively coupled to the discharge aperture, such that a liquid from the discharge aperture flows into the valve via the first opening, and a second opening communicatively coupled to the liquid consumption unit, such that the liquid flows out from the valve via the second opening to the liquid consumption unit;

a valve seat disposed around a periphery of the first opening or the second opening;

a top plate with a third opening in fluid communication with air outside the liquid delivery device;

a diaphragm that is disposed between the bottom plate and the top plate and that includes a first main surface that faces the bottom plate and a second main surface that faces the top plate, such that the diaphragm and the bottom plate of the valve form a first valve chamber and the top plate and the diaphragm form a second valve chamber; and a pressure-applying member disposed between the top plate and the diaphragm to apply pressure on the second main surface of the diaphragm, wherein:

a region of the first main surface of the diaphragm in communication with the first opening has an area $S_P$, the second main surface of the diaphragm has an area $S_S$, the pump has a discharge pressure $P_1$ when a discharge flow rate of the pump is zero, a pressure $P_S$ is applied to the second main surface of the diaphragm by the pressure-applying member, a pressure $P_O$ is applied to a region of the first main surface of the diaphragm that is continuous with the second opening, and wherein $1<\alpha\leq\beta\gamma-\gamma+1$ in a range $0\leq P_O<P_S$, where $\alpha$ equals $S_S/S_P$ ($\alpha>1$), $\beta$ equals $P_1/P_S$ ($\beta>1$), and $\gamma$ % is a flow rate accuracy.

2. The liquid delivery device according to claim 1, wherein the flow rate accuracy $\gamma$ % is 10%.

3. The liquid delivery device according to claim 1, wherein the pressure-applying member includes an adjustment mechanism to adjust the pressure applied to the second main surface of the diaphragm.

4. The liquid delivery device according to claim 3, wherein the adjustment mechanism includes an elastic body and a pressing body that urges the elastic body toward the valve seat.

5. The liquid delivery device according to claim 4, wherein the pressing body is provided in the valve and is rotatable by screwing a screw having a rotational axis in a direction orthogonal to the diaphragm.

6. The liquid delivery device according to claim 5, wherein rotating the pressing body adjusts the pressure applied to the second main surface of the diaphragm.

7. The liquid delivery device according to claim 1, wherein the valve seat is a protruding member that is integrated with the diaphragm.

8. The liquid delivery device according to claim 1, wherein the valve seat is integrated with the bottom plate of the valve.

9. The liquid delivery device according to claim 1, wherein the pressure-applying member is integrated with the diaphragm.

10. The liquid delivery device according to claim 1, wherein the valve seat comprises an O-ring.

11. The liquid delivery device according to claim 10, wherein the O-ring is disposed between the bottom plate and the first main surface of the diaphragm.

12. The liquid delivery device according to claim 11, wherein the O-ring is disposed around the periphery of the second opening of the bottom plate of the valve.

13. The liquid delivery device according to claim 12, wherein, when pressure greater than a threshold resulting from the pressure-applying member is applied to the first main surface of the diaphragm, the diaphragm separates from the O-ring such that the first opening is in fluid communication with the second opening of the bottom plate of the valve.

14. The liquid delivery device according to claim 1, wherein the pressure-applying member is a spring and is disposed in the second valve chamber.

15. The liquid delivery device according to claim 1, wherein the diaphragm and the bottom plate of the valve form a valve chamber between the first opening and the second opening.

16. The liquid delivery device according to claim 1, wherein the bottom plate is flat and the first opening and the second opening are disposed adjacent to each other.

* * * * *